US006811416B2

(12) United States Patent
Yano et al.

(10) Patent No.: US 6,811,416 B2
(45) Date of Patent: Nov. 2, 2004

(54) LEVER FOR REMOVING ELECTRIC APPARATUS

(75) Inventors: Keisuke Yano, Kikuchi-gun (JP); Yojiro Saruwatari, Kumamoto (JP); Ryota Minowa, Yamaga (JP); Tetsuya Fujiwara, Kumamoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 10/400,561

(22) Filed: Mar. 25, 2003

(65) Prior Publication Data

US 2003/0224639 A1 Dec. 4, 2003

(30) Foreign Application Priority Data

Apr. 12, 2002 (JP) ..... 2002-110918

(51) Int. Cl.[7] ..... H01R 13/62
(52) U.S. Cl. ..... 439/157; 439/152
(58) Field of Search ..... 439/152–160

(56) References Cited

U.S. PATENT DOCUMENTS 5,108,298 A * 4/1992 Simmel ..... 439/157
5,135,410 A * 8/1992 Kawase et al. ..... 439/372
5,309,325 A * 5/1994 Dreher et al. ..... 361/754
5,344,194 A * 9/1994 Hatagishi et al. ..... 285/26
5,398,458 A * 3/1995 Henriksen et al. ..... 451/41
5,542,854 A * 8/1996 Bowen ..... 439/157
5,785,540 A * 7/1998 Jaklin ..... 439/157
6,186,804 B1 * 2/2001 Smith et al. ..... 439/157
6,254,409 B1 7/2001 Okabe et al. ..... 439/157
6,368,125 B1 4/2002 Gundermann et al. ..... 439/157
6,551,118 B2 * 4/2003 Langolf et al. ..... 439/157

OTHER PUBLICATIONS

Fujimoto Katsunobu, Patent Abstract of Japan 04087174.

* cited by examiner

*Primary Examiner*—Chandrika Prasad
(74) *Attorney, Agent, or Firm*—Beyer Weaver & Thomas LLP

(57) ABSTRACT

A lever with a generally L-shaped main body with a horizontal arm and a vertical arm joining at an angle-forming part is used for removing an electric apparatus from a connector by rotating it around rotary shafts which protrude coaxially from this angle-forming part and are rotatably supported by the connector such that the horizontal part pushes the bottom surface of the apparatus upward and lifts the mounted electric apparatus. A holding structure, which may be in the form of a frame surrounding the electric apparatus to be removed, protrudes from the horizontal arm away from the rotary shaft so as to come into contact with the surface of the electric apparatus away from the vertical arm when the lever main body is rotated by more than a certain specified angle. The electric apparatus is thus prevented from tilting excessively as it is being lifted and hence can be removed without having its terminals bent or damaged.

5 Claims, 24 Drawing Sheets

LEVER FOR REMOVING ELECTRIC APPARATUS

BACKGROUND OF THE INVENTION

This invention relates to a lever for use in particular for removing an electric apparatus such as a relay or a timer that is connected to a connector for such an electric apparatus.

FIG. 24A shows an example of prior art lever 1 for removing an electric apparatus 5 from the housing 9 of a connector into which it is inserted, having a generally L-shaped main body 2 as seen from the front. Rotary shafts 3 protruding coaxially from both side surfaces of this lever main body 2 at its angle-forming part are inserted into the housing 9 so as to rotatably support the lever 1. When it is desired to remove the apparatus 5 from the housing 9, the lever 1 is rotated such that the horizontal arm 4 of its main body 2 pushes up the bottom surface of the apparatus 5 to remove it from the housing 9. Since the apparatus 5 is pushed only at one point on its bottom surface, as shown in FIG. 24B, however, the apparatus 5 is tilted during the process of its removal, and it cannot be removed smoothly. If the apparatus 5 is tilted by an angle that is too large, in particular, the transverse force exerted on its terminals 6 may become too large and cause them to be bent or broken.

SUMMARY OF THE INVENTION

It is therefore an object of this invention, in view of the problem with such a prior art lever, to provide an improved lever capable of removing an electric apparatus smoothly from a connector housing without bending or breaking the terminals of the apparatus.

A lever according to this invention, with which the above and other objects can be accomplished, may be characterized as comprising not only a generally L-shaped main body having a horizontal arm and a vertical arm joining at an angle-forming part, rotary shafts which protrude coaxially from this angle-forming part to be rotatably supported by the connector such that the horizontal part lifts the mounted electric apparatus as the main body is rotated around these rotary shafts, but also a holding structure which extends from the horizontal arm in a direction away from the shafts and is adapted to come into contact with the surface of the electric apparatus facing away from the vertical arm when the main body is rotated by more than a certain specified angle. With the lever provided with such a holding structure, the electric apparatus being removed is prevented from tilting excessively with the holding structure coming into contact therewith such that the apparatus can be removed smoothly without causing its terminals to be bent and damaged. If this holding structure is in the form of a frame, its mechanical strength is improved and the electric apparatus being removed can be more dependably prevented from tilting excessively.

As a variation, connecting arms may be provided for connecting the holding structure and the vertical arm of the lever. This has the advantage of reinforcing the extended holding structure. As a further variation, at least one latch may be provided beside the vertical part, say, on the aforementioned connecting arm for engaging with the electric apparatus for more dependably preventing the electric apparatus from floating up or falling off the housing structure.

As still another variation, the vertical arm may be provided with an attachment part for a name plate near its top end. Such a name plate is convenient because various data may be written on.

BRIEF DESCRIPTION OF THE DRAWINGS

Throughout herein, comparable or like components are indicated by the same numerals even where they are components of different connectors and may not be repetitiously described.

DETAILED DESCRIPTION OF THE INVENTION

Figure 1:
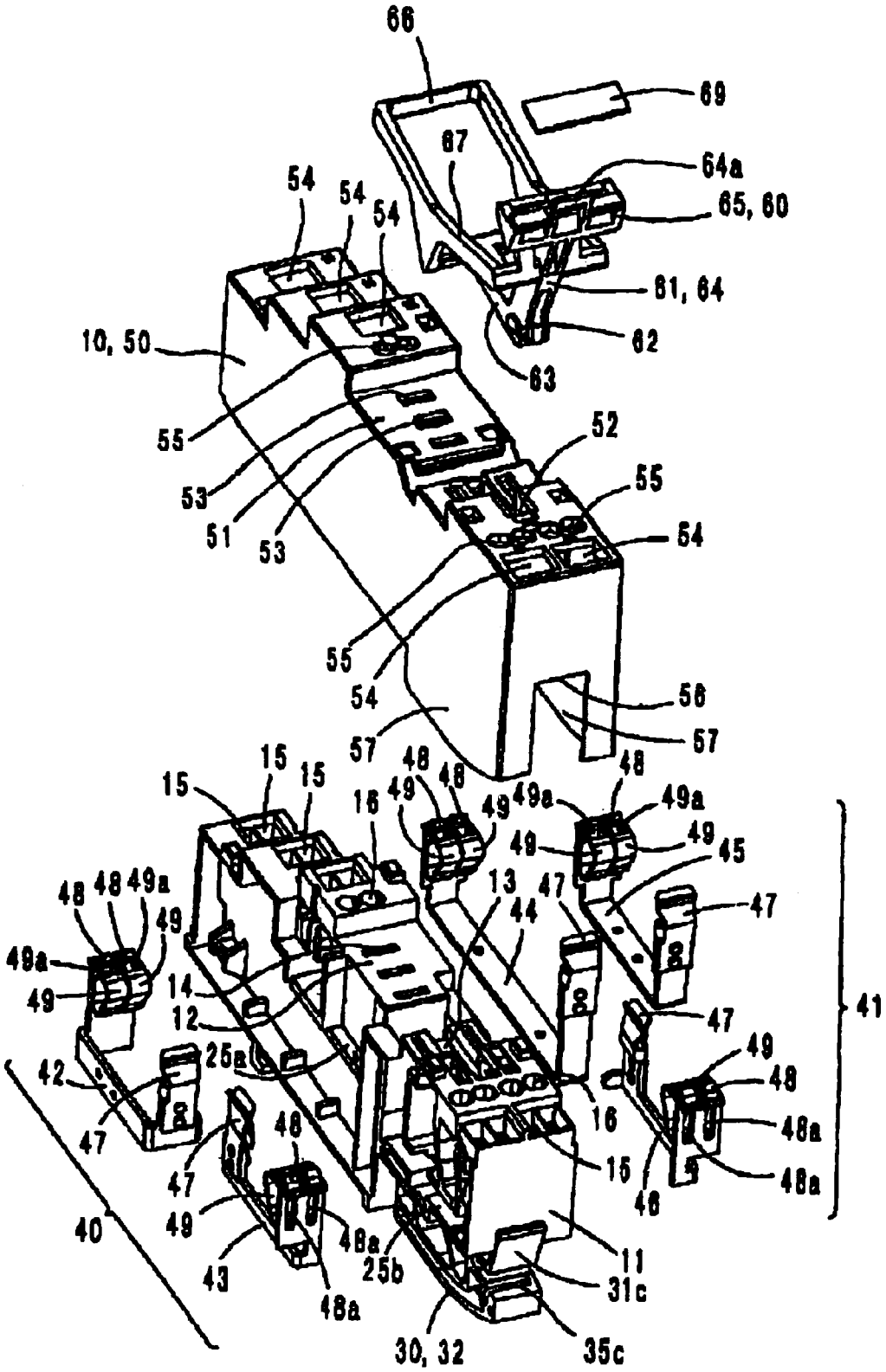
FIG. 1 is an exploded diagonal view of a connector including a lever embodying this invention for an electric apparatus.
Figure 2A:
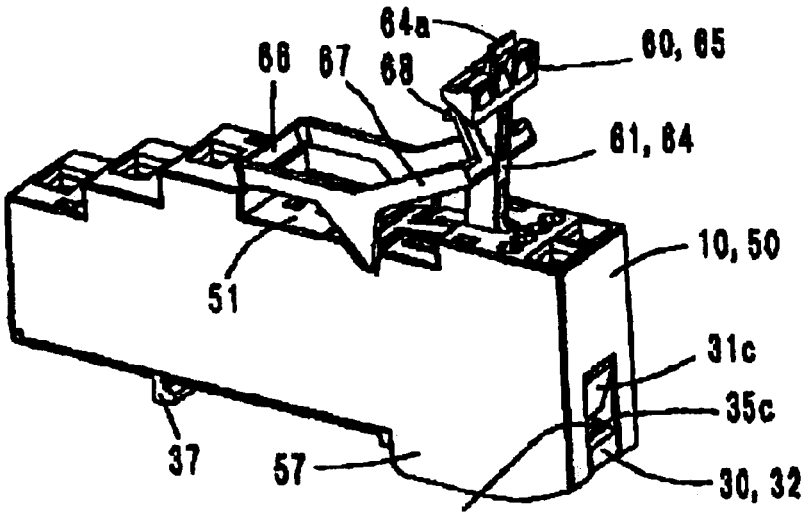
FIGS. 2A, 2B and 2C, together referred to as FIG. 2, are diagonal views of the connector of FIG. 1 for showing how it is used.
Figure 2B:
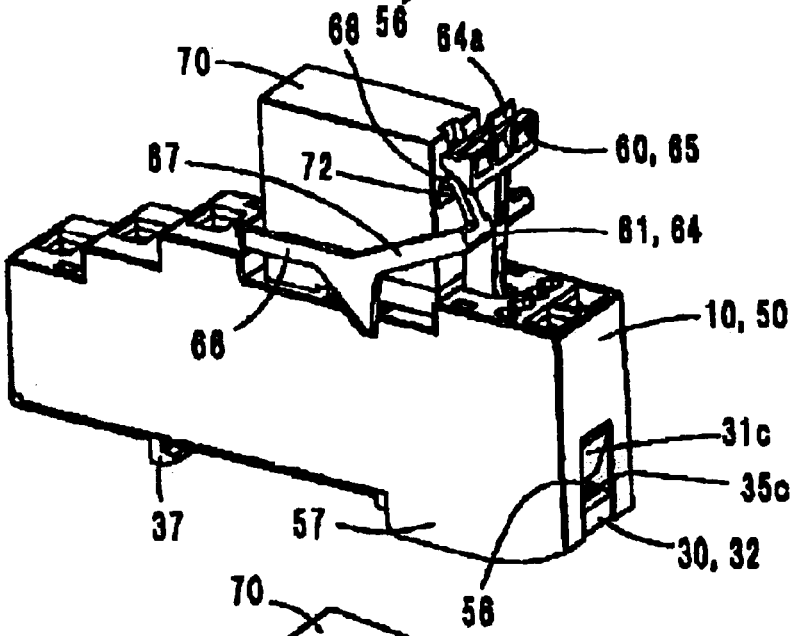
Figure 2C:
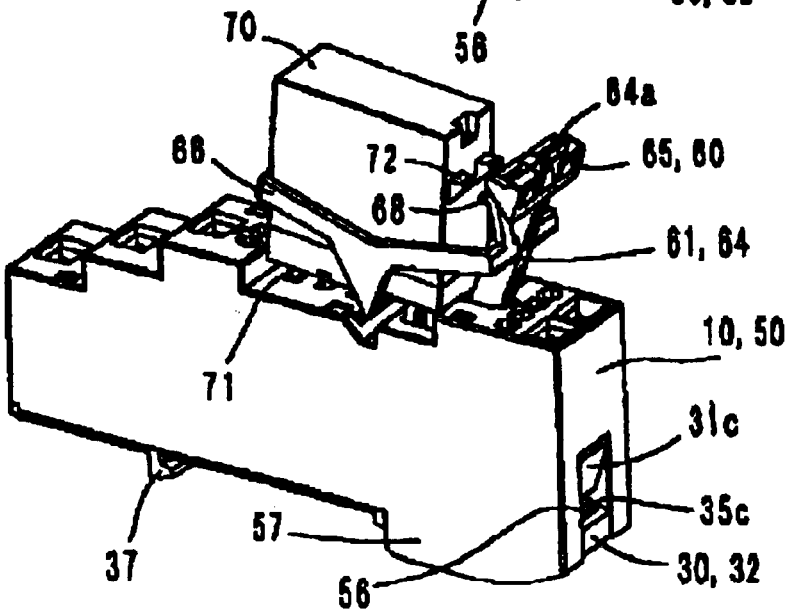

The invention is described next with reference to FIGS. 1–15 showing an example as applied to a connector 10 for mounting a one-pole relay. As shown in FIG. 1, this connector 10 is comprised of a base 11, connecting mechanisms 40 and 41 attached to both sides of this base 11, a case 50 which engages with the base 11 and a lever 60 which is rotatably attached toward one side of the upper surface of the base 11.

The base 11 is a molded resin product having a rail attachment mechanism 30 integrally formed on its bottom surface. An indentation 12 for mounting therein a relay (shown at 70 in FIGS. 2B and 2C) is formed in the middle on the top surface of the base 11. Steps are formed on the top surface of the indentation 12 toward one side. A groove 13 for inserting the lever 60 is formed at the bottom of the indentation 12, and a plurality of terminal-accepting holes 14 for accepting the terminals 71 (shown in FIG. 13C) of the relay 70 are provided near the groove 13.

Figure 8A:
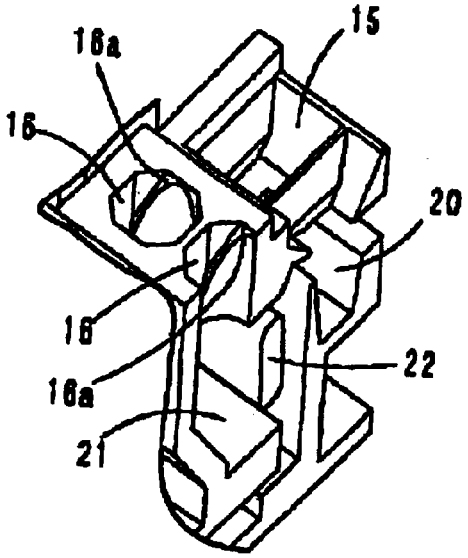
FIGS. 8A, 8B, 8C and 8D, together referred to as FIG. 8, are respectively an enlarged diagonal view of a portion of the base shown in FIG. 1, its sectional view, an enlarged diagonal view of another base and its sectional view.
Figure 8B:
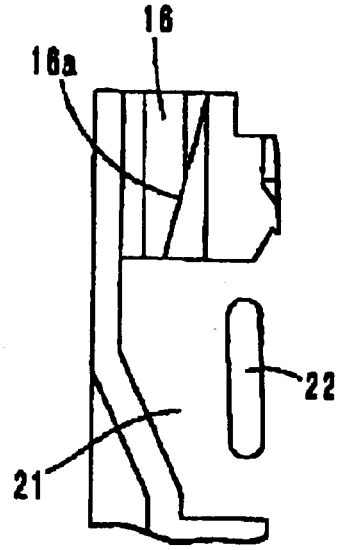
Figure 8C:
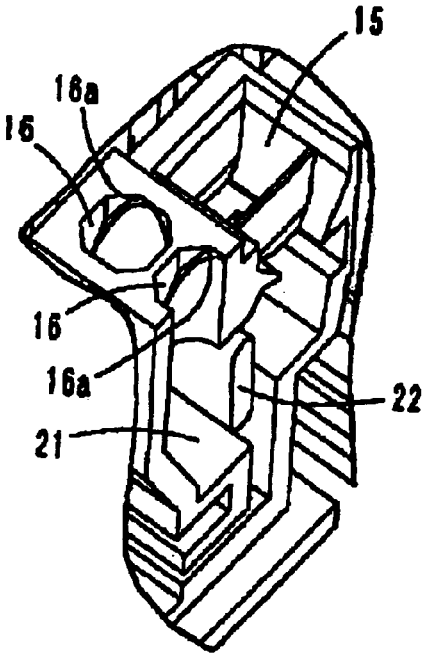
Figure 8D:
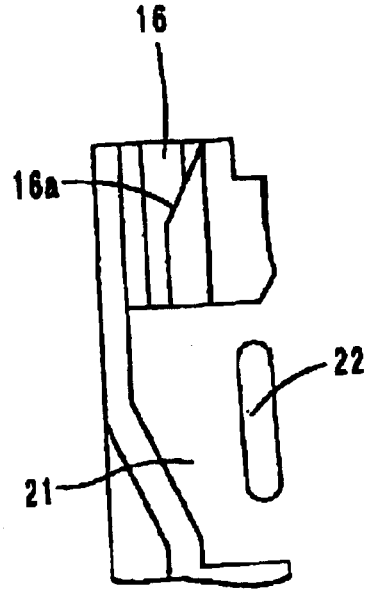
Figure 9A:
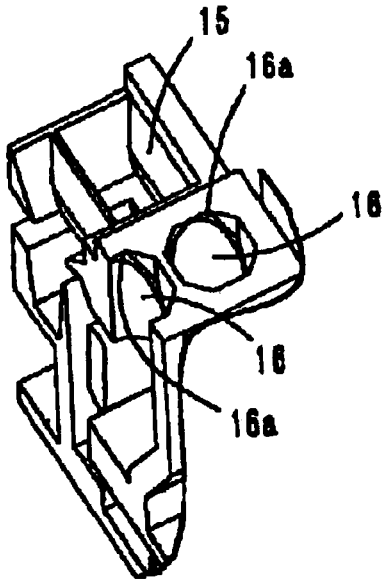
FIGS. 9A, 9B, 9C and 9D, together referred to as FIG. 9, are respectively an enlarged diagonal view of a portion of a different base, its sectional view, an enlarged diagonal view of a portion of still another base, and its sectional view.
Figure 9B:
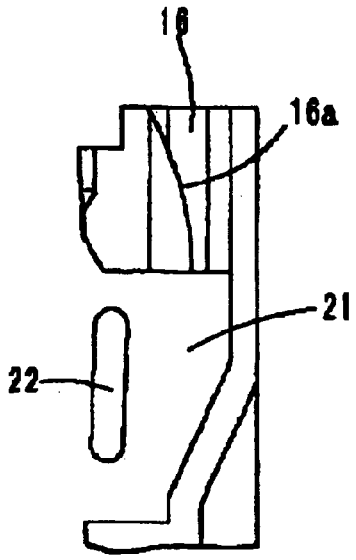
Figure 9C:
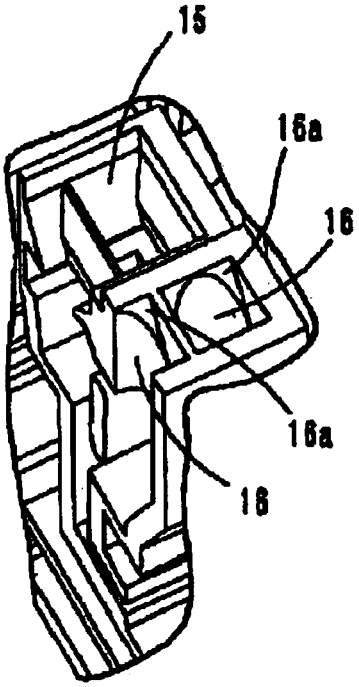
Figure 9D:
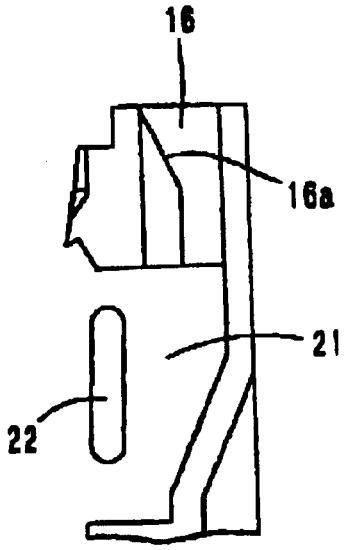
Figure 10A:
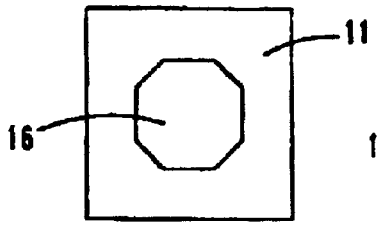
FIGS. 10A, 10B, 10C, 10D, 10E and 10F, together referred to as FIG. 10, are drawings for explaining the shape of the handling bar hole, FIGS. 10A and 10B being respectively a plan view and a diagonal view at an initial step of its formation, FIGS. 10C and 10D being respectively a plan view and a diagonal view at an intermediate step, and FIGS. 10E and 10F being respectively a plan view and a diagonal view at a final step.
Figure 10C:
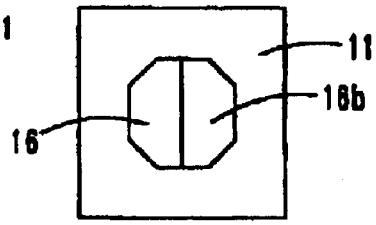
Figure 10E:
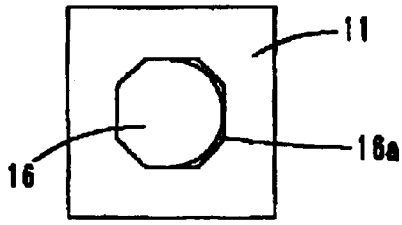
Figure 10B:
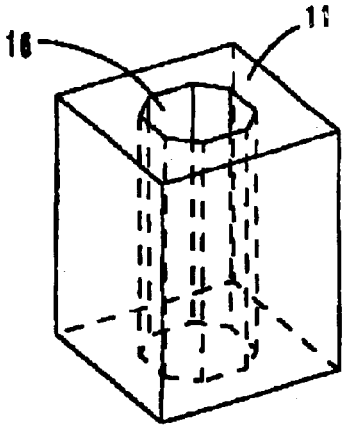
Figure 10D:
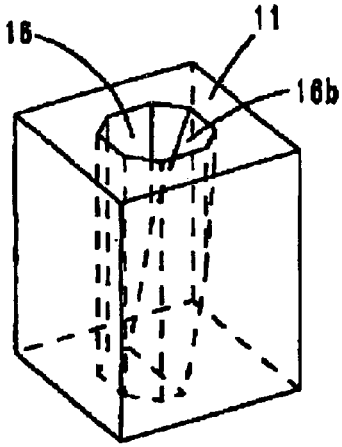
Figure 10F:
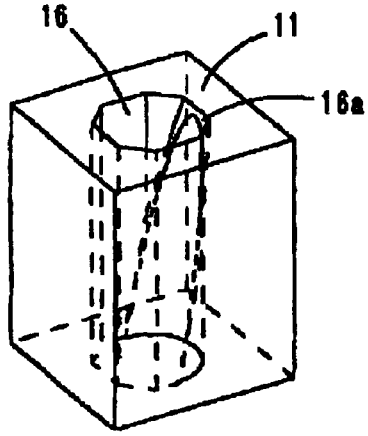

Lead line holes 15 for inserting lead lines and handling bar holes 16 for inserting a handling bar 80 are provided on the top surface of the base 11 on both sides of the indentation 12 at a specified pitch. As shown in FIG. 8, a guide surface 16*a* for guiding the handling bar 80 is formed inside each handling bar hole 16. The guide surface 16*a* is formed by forming a tapered flat surface 16*b* as shown in FIGS. 10C and 10D inside a sectionally octagonal straight hole 16 shown in FIGS. 10A and 10B and then cutting the tapered surface 16*b* as shown in FIGS. 10E and 10F. The guide surface 16*a* is not required to extend to the bottom opening of the hole 16 but may extend only partially, as shown in FIGS. 8C and 8D. Alternatively, as shown in FIGS. 9A and 9B, the guide surface 16*a* may be formed with a curved surface. As shown in FIGS. 9C and 9D, furthermore, the guide surface 16*a* may be formed from a sectionally square-shaped hole 16, extending only partially to the bottom.

Directly below the lead line holes 15, a U-shaped pocket 20 is prepared, as shown in FIG. 7 for collecting scraps of lead lines which may be generated when the lead lines are forcibly pulled out. Directly below the handling bar holes 16, a storage space 21 is prepared for a clamp spring 49. A stopper 22 for limiting the elastic deformation and preventing plastic deformation of the clamp spring 49 protrudes into this storage space 21.

Partition walls 23 for the pockets 20 are formed opposite to and at a specified distance from the stopper 22 so as to be adjacent to end parts of metal fittings 42–46 (of connecting mechanisms 40 and 41 to be described below) such that the end parts of the metal fittings 42–46 are clamped between one of the partition walls 23 and a corresponding one of the stoppers 22.

As shown in FIG. 1, grooves 25*a* and 25*b* are formed on one side surface of the base 11 for pushing the metal fittings 42 and 43*s* of the connecting mechanism 40 respectively thereinto from one side. Similar grooves 26*a*, 26*b* and 26*c* are formed, as shown in FIG. 6, on the opposite side surface of the base 11 for pushing the metal fittings 44, 45 and 46 of the connecting mechanism 41 respectively thereinto from the opposite side. The upper part on one side of each of these grooves 25*a*, 25*b*, 26*a*, 26*b* and 26*c* is connected to one of the terminal-accepting holes 14, while the upper part on the other side of these grooves 25*a*, 25*b*, 26*a*, 26*b* and 26*c* is connected to the corresponding U-shaped pocket 22 and storage space 21.

Figure 3:
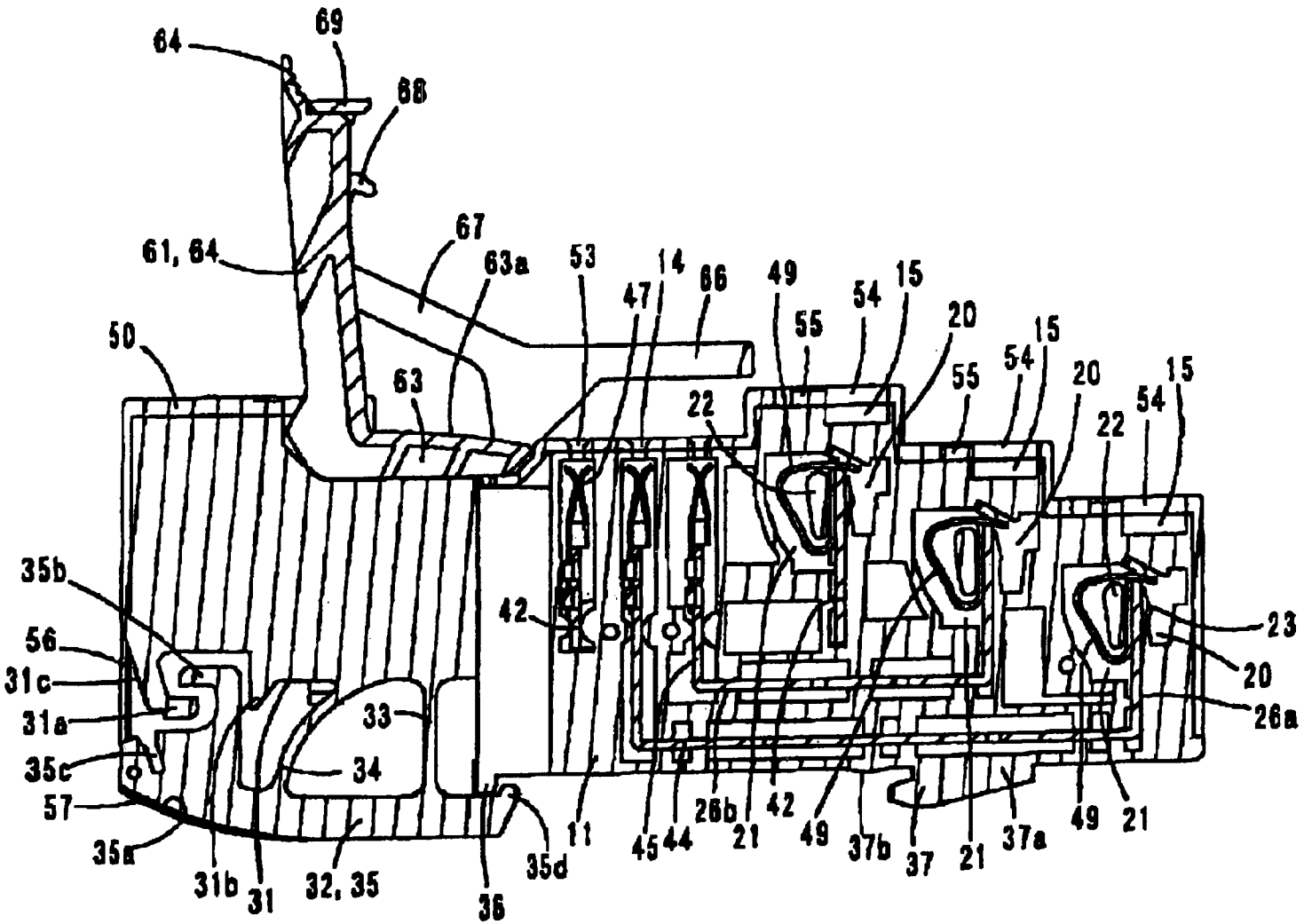
FIG. 3 is a longitudinal sectional view of the connector of FIG. 1.
Figure 4A:
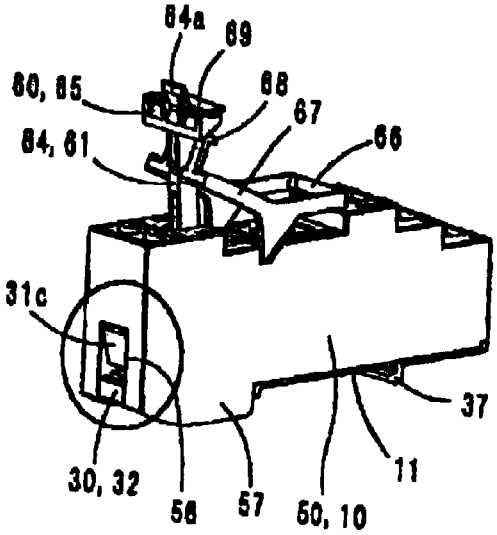
FIGS. 4A, 4B and 4C, together referred to as FIG. 4, are respectively a diagonal view of the connector of FIG. 1 taken from a different angle, an enlarged diagonal view of its portion and a sectional view of a portion of FIG. 4A.
Figure 4B:
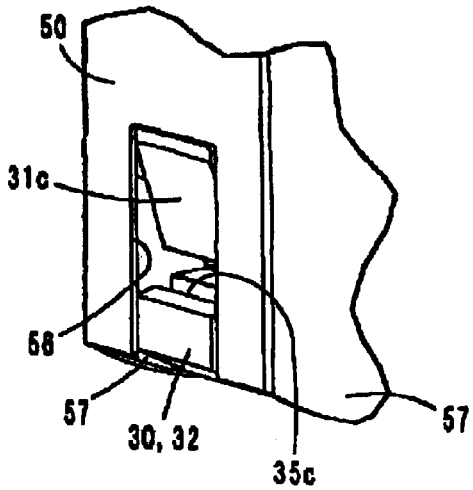
Figure 4C:
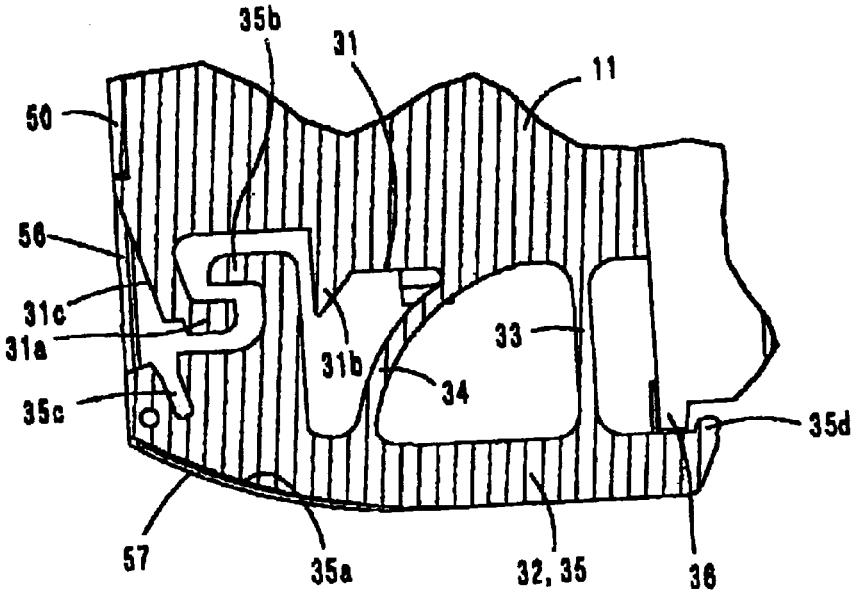

The rail attachment mechanism 30 is formed, as shown in FIGS. 3 and 4, by forming a stepped part 31 on one side of the bottom surface of the base 11 and having an elastic hook 32 protruding downward from the ceiling of the stepped part 31. This elastic hook 32 is integrally formed by connecting a movable horizontal latch part 35 at the bottom ends of a pair of straight and arched leg parts 33 and 34. The latch part 35 has a curved surface 35*a* on the bottom towards one end, a protrusion 35*b* on the upper surface for engagement and an indentation 35*c* at its base.

The protrusion 35*b* for engagement is adapted to contact both a latch part 31*a* and a stopper 31*b* protruding from the stepped part 31 for preventing the hook 32 from being damaged when the connector 10 is dropped. The indentation 35*c* is for inserting a removal tool for removing the connector 10 from a rail (now shown). The latch part 31*a* has an outwardly facing surface 31*c* which is inclined so as to guide the removal tool into the indentation 35*c* provided on the extension of this inclined surface 31*c*.

Another protrusion 35*d* is formed on the opposite end part of the horizontal latch part 35. An elongated downward protrusion 36 is formed on the bottom surface of the base 11 such that an edge part of a rail (not shown) can be engaged with the base 1, being slidably sandwiched between these protrusions 35*d* and 36.

FIG. 3 also shows that the bottom surface of the base 11 on the opposite side is further provided with a latch part 37 parallel to and at a specified distance from the aforementioned protrusion 36. This latch part 37 is provided with a reinforcing rib 37*a* 10 and a protrusion 37*b* near by for preventing rattling when it is mounted onto the rail.

The (first) connecting member 40 is comprised of (first and second) metal fittings 42 and 43 for connecting the terminals 71 of the relay 70 to lead lines (not shown). The (second) connecting member 41 is comprised of (third, fourth and fifth) metal fittings 44, 45 and 46. The second and fifth metal fittings are shaped in plane symmetry with respect to each other.

Each of these metal fittings 42–46 has a socket structure 47 locked to the top end of one of vertically rising parts and the top end of the other vertically rising part split into two parts in the direction of the width and folded to form bent parts 48. Each of the bent parts 48 is provided with a clamp spring 49. Holes 48*a* are formed below these bent parts 48 for supporting the metal fittings 42–46 when the clamp springs 49 are attached. Each of the clamp springs 49 has a connection hole 49*a* near one of its end parts of an elongated elastic plate and is bent into a nearly annular shape. The other end part of the clamp spring 49 engages the inner side of the bent part 48 of the corresponding one of the metal fittings 42–46. The connection hole 49*a* engages the bent part 48 such that the inner edge of the connection hole 49*a* engages the outer side of the bent part 48. The inner edge of the connection hole 49*a* of the clamp spring 49 is biased by its own elastic force and is pressed against the outer side surface of the bent part 48.

Thus, the metal fittings 42–46 can be pressed into the grooves 25*a*, 25*b*, 26*a*, 26*b* and 26*c* of the base 11 from its sides and the clamp springs 49 become contained inside the storage spaces 21 of the base 11, the stoppers 22 becoming engaged therewith. At the same time, the holes 48*a* through the metal fittings 42–46 are blocked by the partition walls 23 such that scraps of lead lines are prevented from falling therethrough into the neighboring storage space 21. The aforementioned socket structure 47 is positioned directly below the terminal-accepting holes 14, and the clamp springs 49 are directly below the handling bar holes 16.

As shown in FIG. 1, the case 50 is a molded product in the shape of a box engageable with the base 11. An indentation 51 for mounting therein the relay 70 is formed in the middle on the top surface of the case 50. Steps are formed on the top surface of the indentation 51 at one side. A slit 52 for inserting the lever 60 is formed at the center of the bottom surface of the indentation 51, and a plurality of terminal accepting holes 53 are provided around the slit 52. Lead line holes 54 for inserting lead lines and handling bar holes 55 for inserting the handling bar 80 are provided on the top surface on both sides of the indentation 51 at a specified pitch.

As shown in FIG. 4, an end portion of an edge surface of the case 50 is cut open to form an opening 56. Both sides of the opening 56 contact a side edge part of the elastic hook 32 when the case 50 is engaged with the base 11 such that the elastic hook 32 is prevented from becoming twisted and damaged. The opening 56 also allows the user to see the outwardly facing surface 31*c* of the latch part 31*a* therethrough such that the aforementioned removal tool (not shown in FIG. 4) can be easily slid along this outwardly facing surface 31*c* into the indentation 35*c*. The side walls of the case 50 have downwardly extended portions 57 for protecting the elastic hook 32 from an impact force, having lower edges contoured along the bottom surface of the elastic hook 32.

As shown in FIG. 5, the case 50 is further provided with a protrusion 58 in its interior. This protrusion 58 is shaped so as to be engageable with the sideward opening of the U-shaped pocket 20 of the base 11. A partition wall 59 is also formed inside for closing the pocket 20 and the storage space 21 for the clamp spring 49. This partition wall 59 is formed with a protrusion 59*a* on its lower edge for being engagingly inserted into an opening 11*a* in the base 11.

As the case 50 is engaged with the base 11, the lead line holes 15 and the handling bar holes 16 of the base 11 come to communicate respectively with the lead line holes 54 and the handling bar holes 55 of the case 50. At the same time, the protrusion 58 inside the case 50 engages and blocks the side opening of the pocket 20 of the base 11, while the side opening of the adjacent pocket 20 and storage space 21 is blocked by the partition wall 59 of the case 50. In particular, since the protrusion 59*a* from the partition wall 59 engages the opening 11*a* in the base 11, the partition wall 59 is prevented from warping outward. Thus, no gap is generated between the outer side surface of the base 11 and the inner side surface of the case 50. This serves to prevent scraps of lead lines collected in the pocket 20 from falling along the inner side surface of the partition wall 59 and thereby causing defective insulation.

Figure 11A:
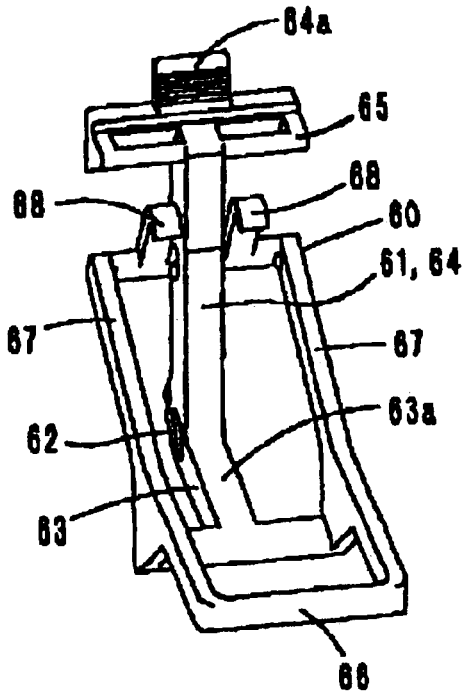
FIGS. 11A, 11B and 11C, together referred to as FIG. 11, show the lever of FIG. 1, FIGS. 1A and 11B being its diagonal views and FIG. 11C being its front view.
Figure 11B:
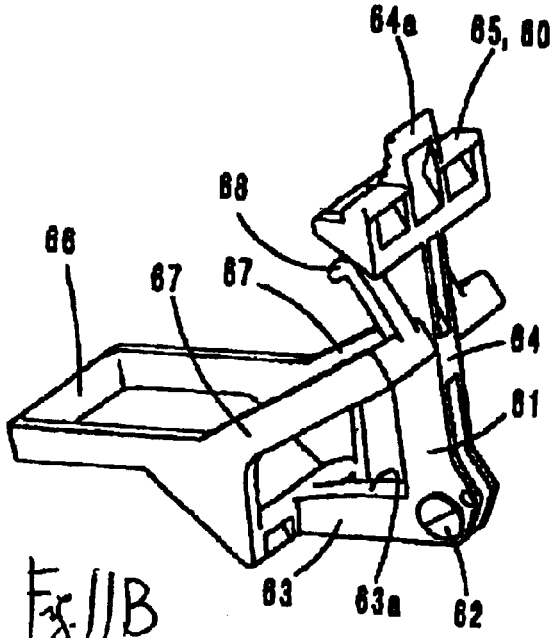
Figure 11C:
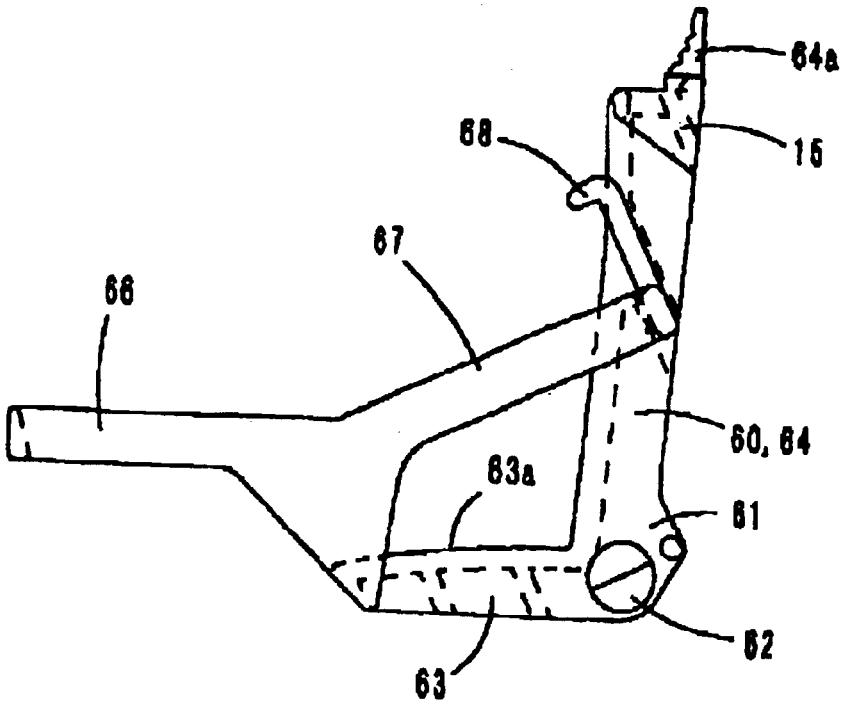
Figure 12A:
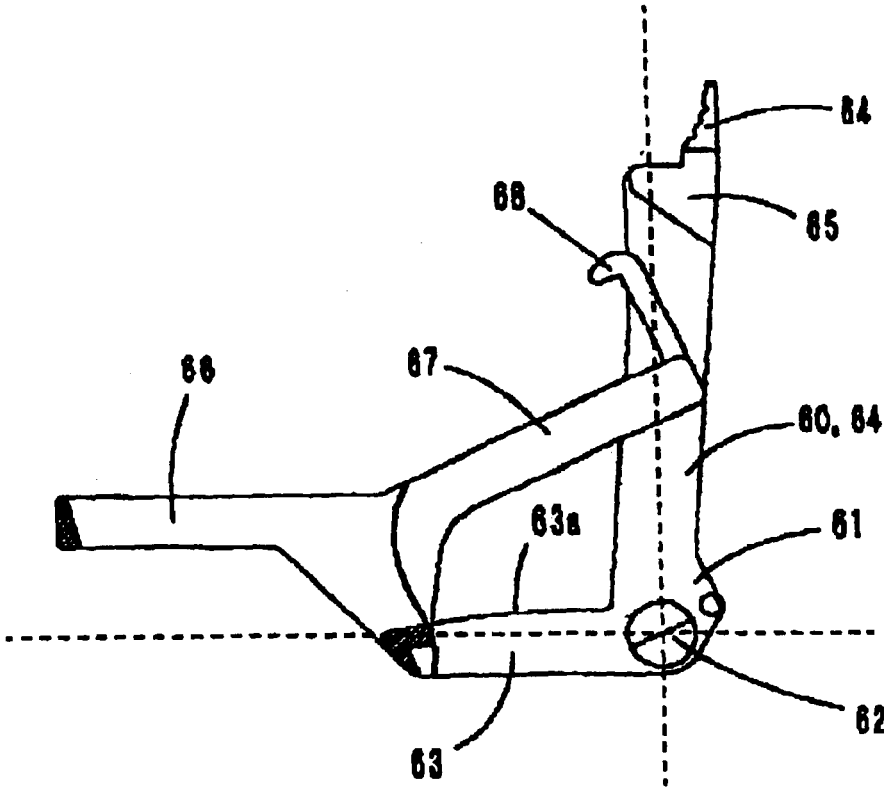
FIGS. 12A and 12B, together referred to as FIG. 12, are front views of the lever for showing its motion in operation.
Figure 12B:
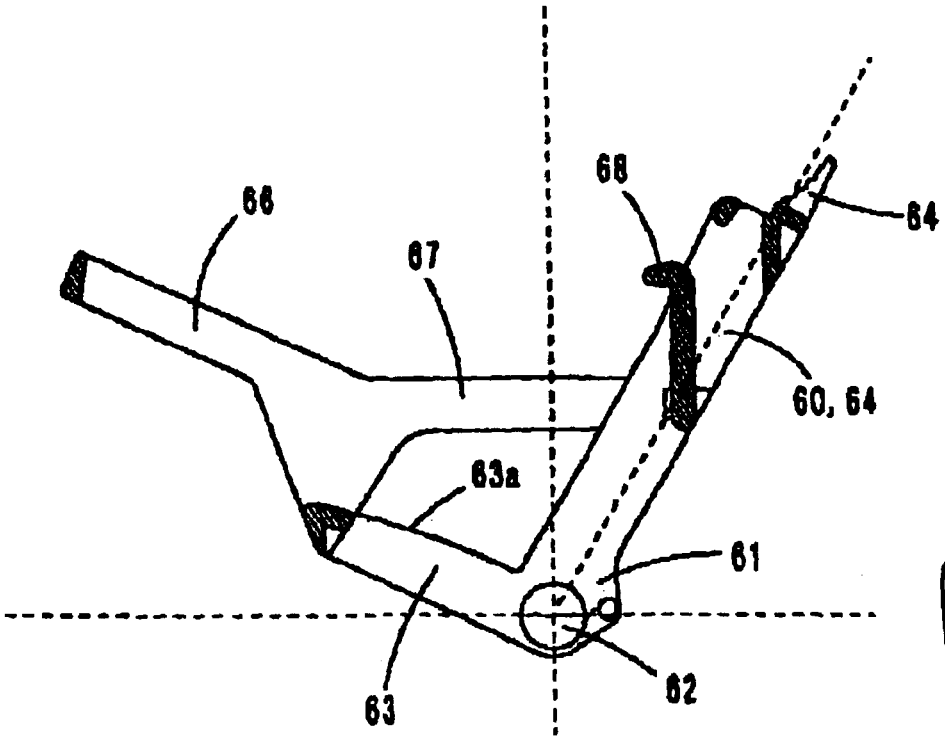

As shown in FIGS. 11 and 12, the lever 60 has a main body 61 which is L-shaped as seen from the forward direction. Rotary shafts 62 protrude coaxially from both side surfaces of the lever main body 61 at its angle-forming part. The horizontal arm 63 of the main body 61 has a curved upper surface 63*a* for smoothly pushing up the relay 70. The vertical arm 64 has an integrally formed attachment part 65 for attaching a removable name plate 69 (shown in FIG. 1) thereon. The name plate 69 thus positioned near the top end part 64*a* of the vertical arm 64 is convenient because it can be easily seen by the user. If necessary, the name plate 69 may be attached on the front side or back side of the vertical arm 64.

A frame structure 66 for limiting the tilting motion of the electric apparatus (such as the relay 70) is provided, extending from the horizontal arm 63. This frame structure 66 and the vertical arm 64 are connected by a pair of connecting arms 67. Two latches 68 protrude beside the vertical arm 64 and from the connecting arms 67, as shown in FIGS. 11 and 12.

Figure 5B:
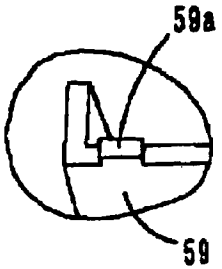
FIGS. 5A, 5B, 5C and 5D, together referred to as FIG. 5, are respectively a diagonal view of the case taken from a different direction, an enlarged portion of FIG. 5B, a diagonal view of the base taken from a different direction, and an enlarged portion of FIG. 5C.
Figure 5D:
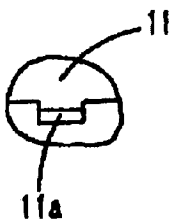
Figure 5A:
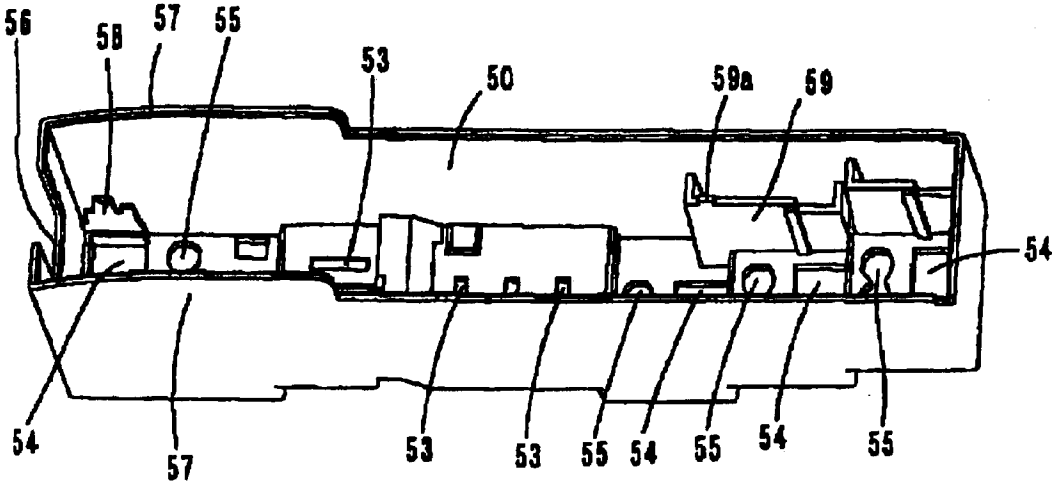
Figure 5C:
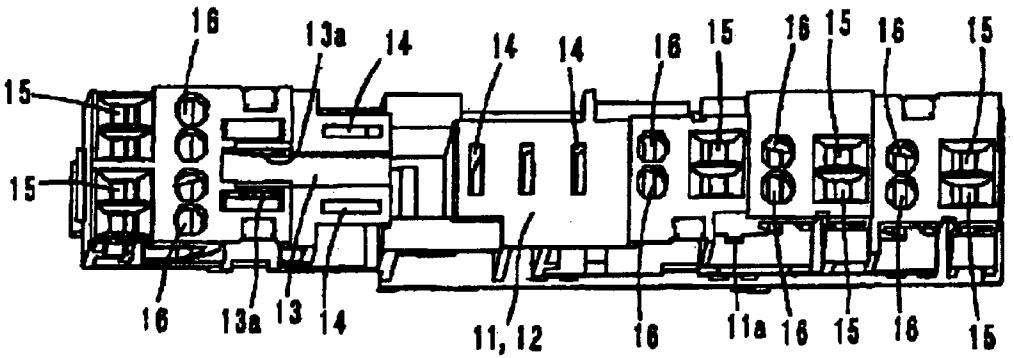
Figure 6A:
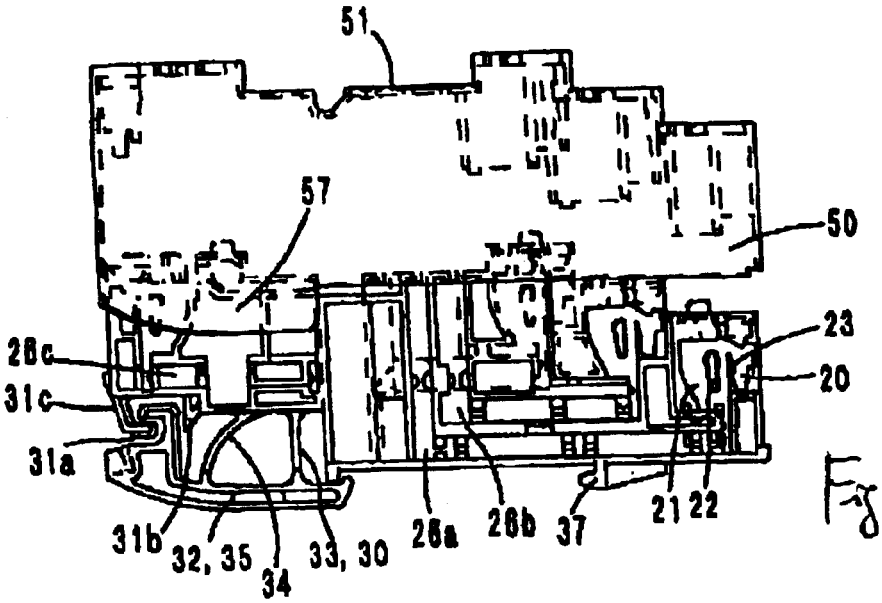
FIGS. 6A, 6B, 6C and 6D, together referred to as FIG. 6, are respectively a front view of the connector of FIG. 1 when the case is being engaged to the base, a front view when the case has been engaged to the base, a sectional view taken along line 6C—6C of FIG. 6B and a sectional view taken along line 6D—6D of FIG. 6B.
Figure 6B:
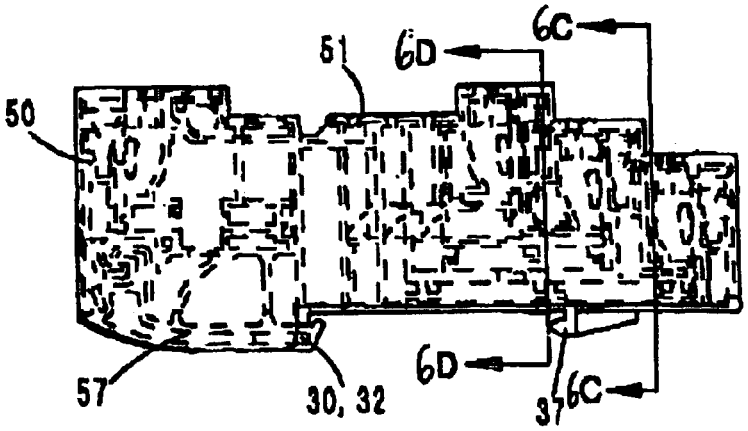
Figure 6C:
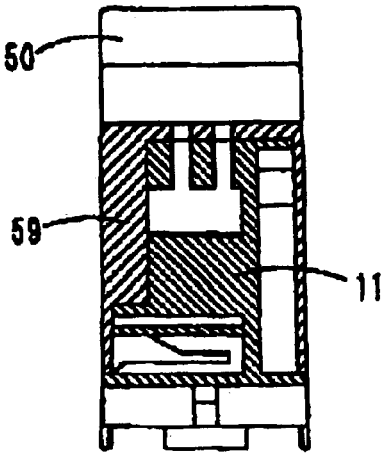
Figure 6D:
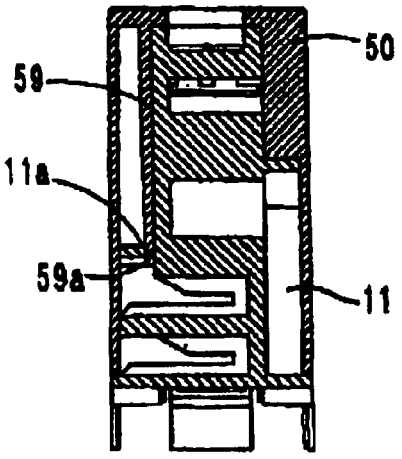
Figure 7A:
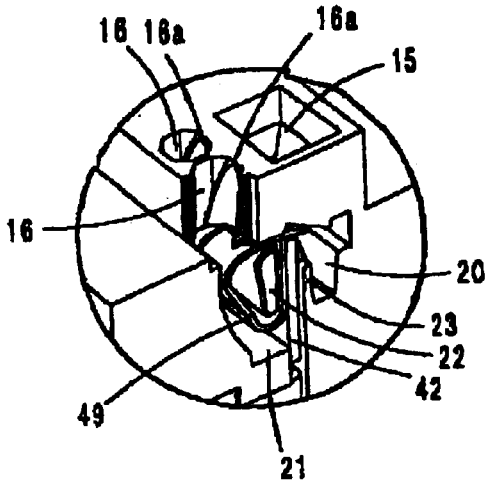
FIGS. 7A, 7B, 7C and 7D, together referred to as FIG. 7, are enlarged views of a portion of the connector of FIG. 1 for showing how it is used with a handling bar.
Figure 7B:
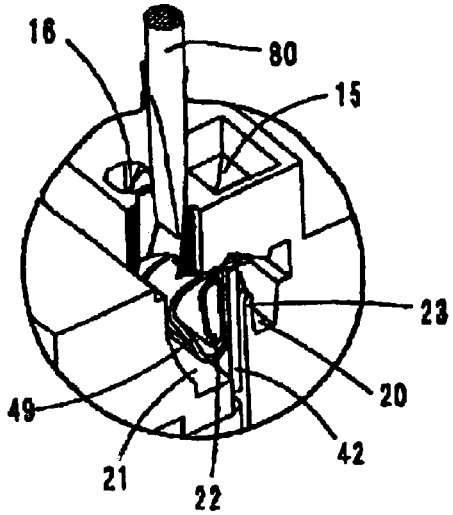
Figure 7C:
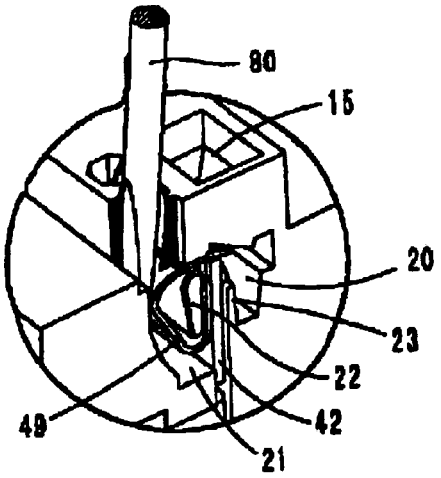
Figure 7D:
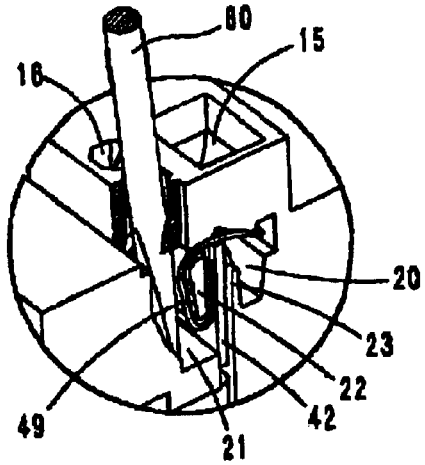

The lever 60 is inserted into the groove 13 on the base 11 through the slit 52 in the case 50 such that it engages the openings 13*a* on both side surfaces of the groove 13, as shown in FIG. 5C, and becomes rotatably supported by the base 11. With the lever 60 in this tilted condition, the relay 70 is inserted into the frame structure 66 from above and pushed further downward into the socket structures 47. As a result, the lever 60 is rotated and the latches 68 come to be engaged with positioning protrusions 72 from side surfaces of the relay 70, as shown in FIG. 13, such that the relay 70 is prevented from moving up, rattling or falling off.

Figure 13A:
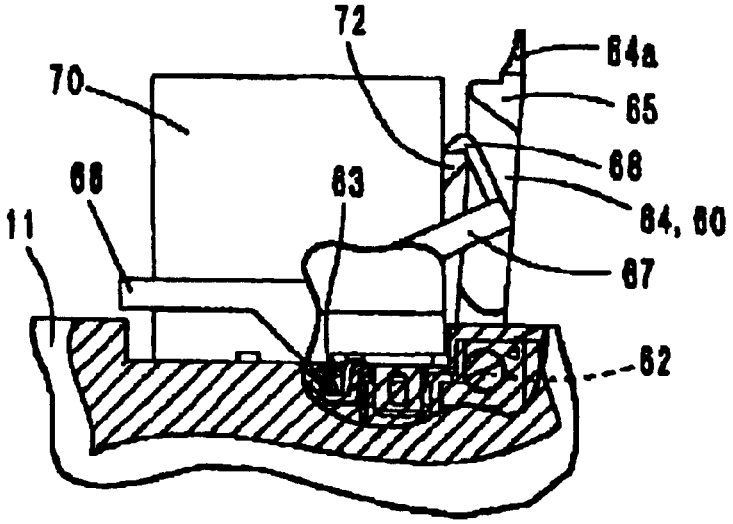
FIGS. 13A, 13B and 13C, together referred to as FIG. 13, are partially sectional views of the lever of FIG. 11 for showing the method of using it.
Figure 13B:
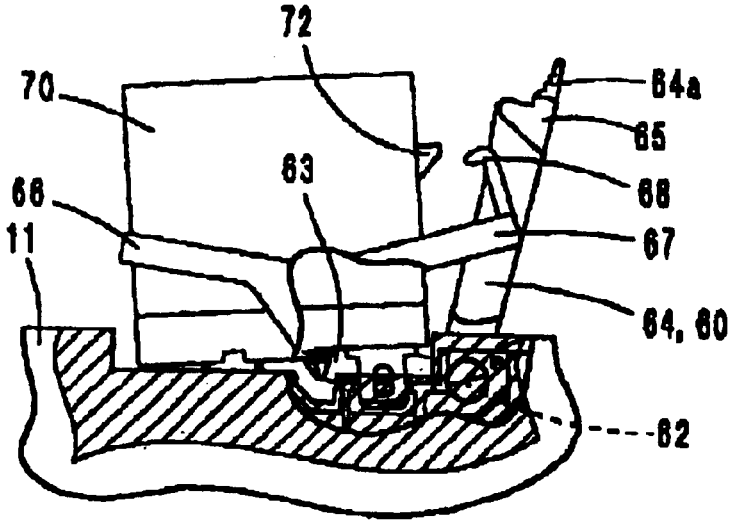
Figure 13C:
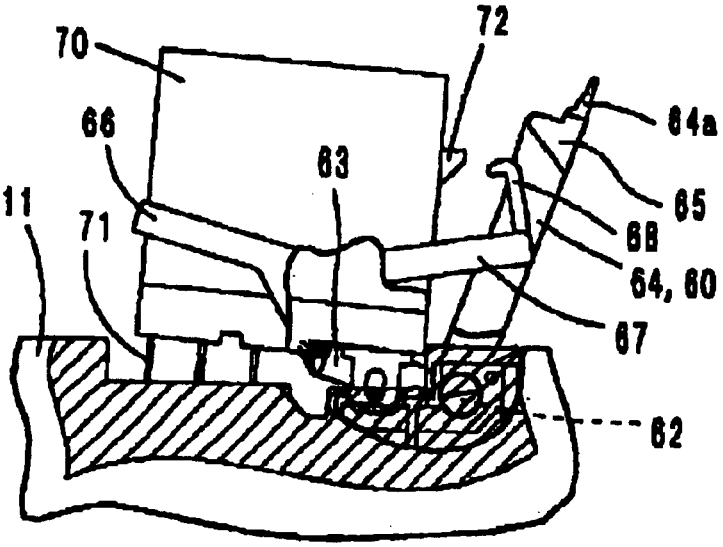

When the relay 70 is removed from the connector 10, the lever 60 is rotated as shown in FIG. 13 such that the base portion of the horizontal part 63 pushes the edge parts of the bottom surface of the relay 70 upward, causing the latches 68 on the lever 60 to disengage from the positioning protrusions 72 on the relay 70. As the lever 60 is further rotated, the point of contact moves towards the tip of the horizontal arm 63 and the relay 70 is pushed upward while being tilted. As the lever 60 is rotated by a certain angle, the frame structure 66 comes to contact the side surface of the relay 70 opposite and away from the vertical arm 64, as shown in FIG. 13B, such that the relay 70 is lifted up from the opposite side, as shown in FIG. 13C. Thus, the relay 70 can be lifted up and removed from the connector 10 smoothly as a whole without tilting excessively and hence without bending the terminals 71.

Figure 14A:
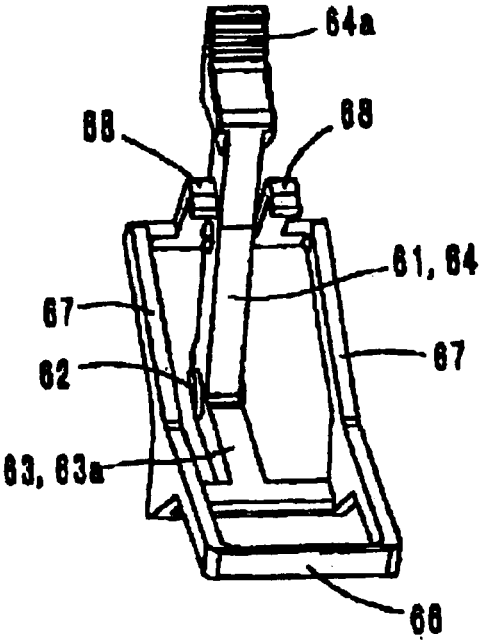
FIGS. 14A, 14B, 14C and 14D, together referred to as FIG. 14, are diagonal views of other levers embodying this invention.
Figure 14B:
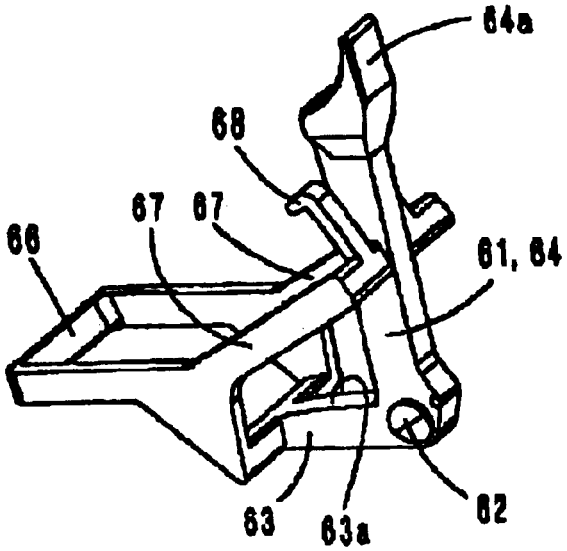
Figure 14C:
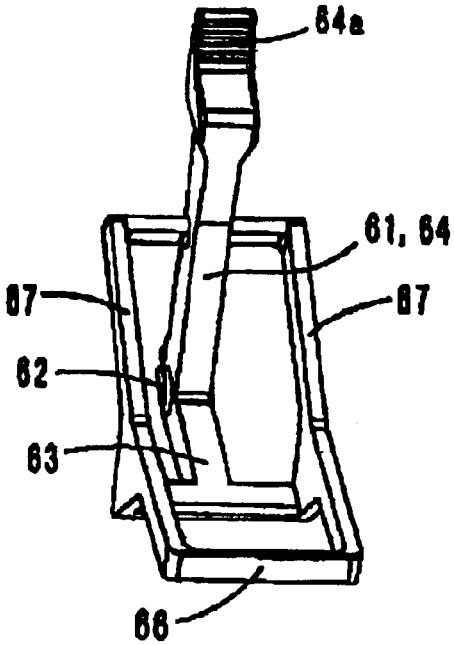
Figure 14D:
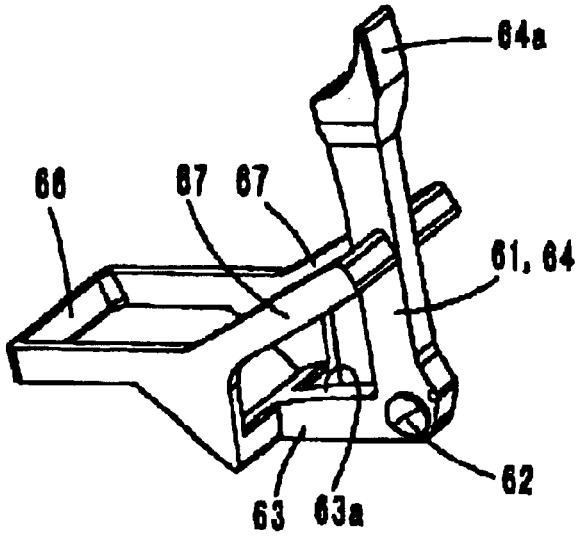
Figure 15A:
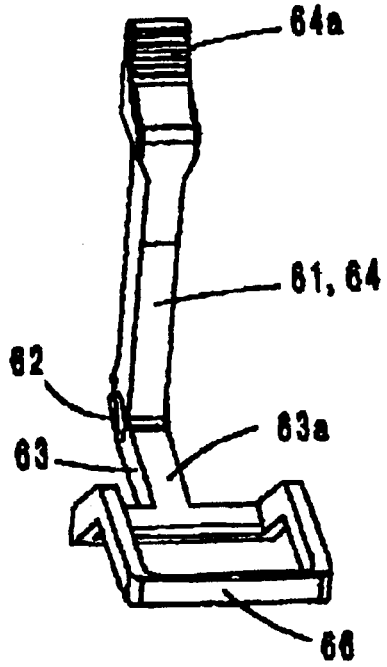
FIGS. 15A, 15B, 15C and 15D, together referred to as FIG. 15, are diagonal views of still other levers embodying this invention.
Figure 15B:
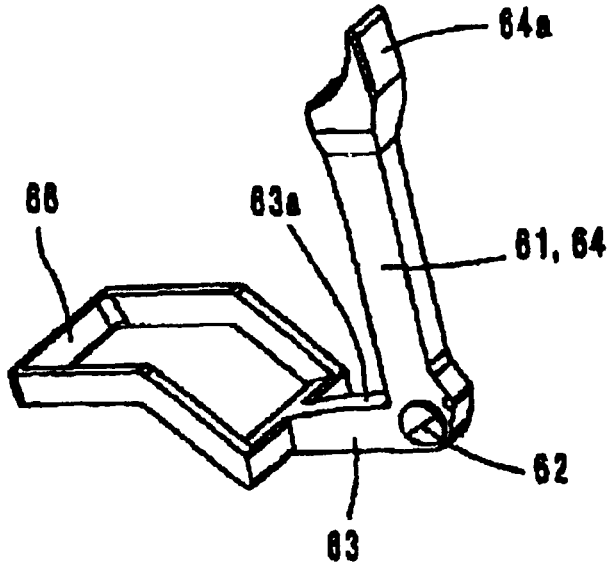
Figure 15C:
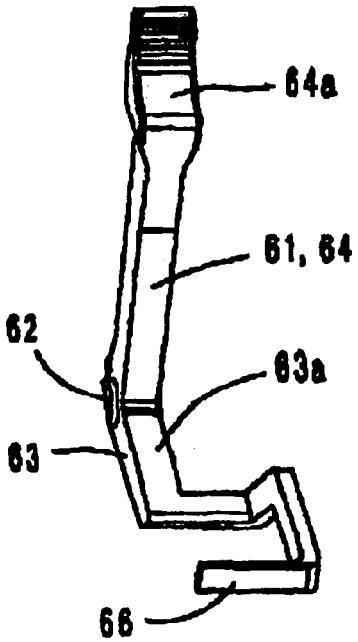
Figure 15D:
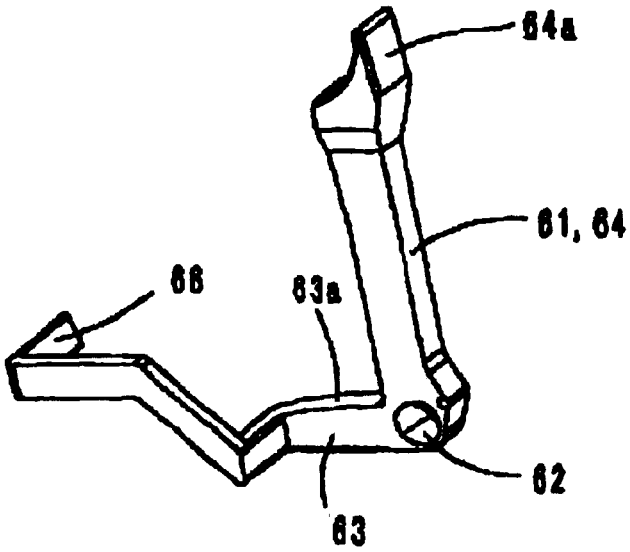
Figure 16A:
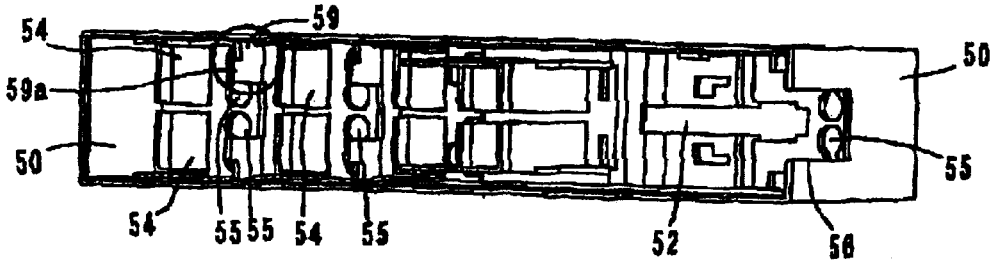
FIG. 16A, 16B, 16C, 16D and 16E, together referred to as FIG. 16, show another connector embodying this invention, FIG. 16A being a diagonal view of its case, FIG. 16B being an enlarged view of a portion thereof, FIG. 16C being a diagonal view of its base, FIG. 16D being an enlarged view of a portion thereof, and FIG. 16E being a diagonal view of its base taken from a different direction.
Figure 16C:
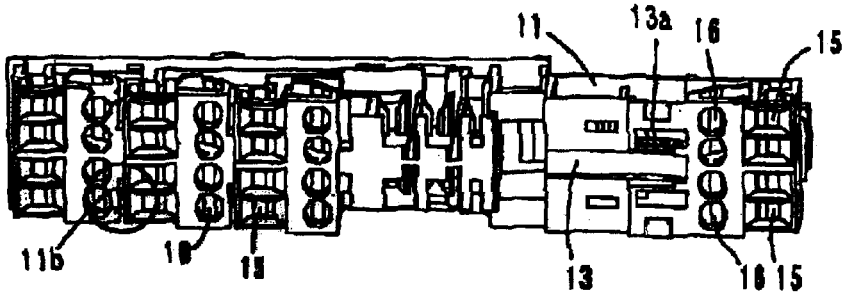
Figure 16E:
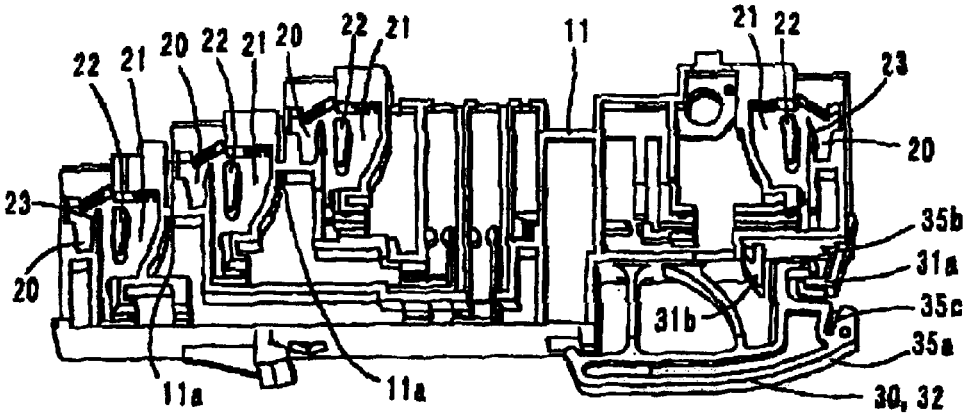
Figure 16B:
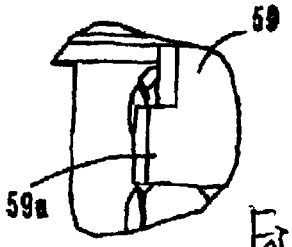
Figure 16D:
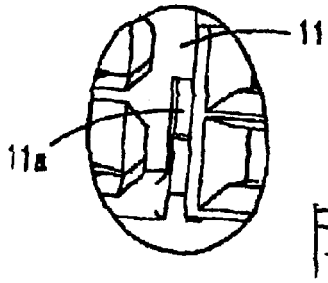
Figure 17A:
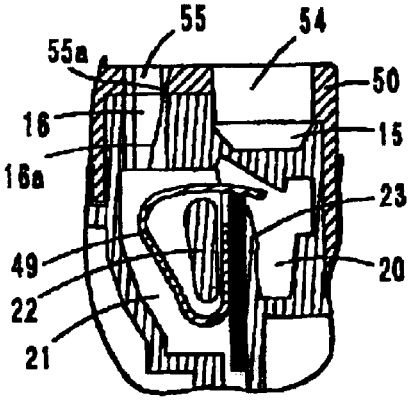
FIGS. 17A, 17B, 17C, 17C and 17D, together referred to as FIG. 17, show the connector of FIG. 16, FIG. 17 A being its partially sectional view, FIG. 17B being a diagonal view of a portion of the connector, FIG. 17C being a diagonal view of a portion of its base, and FIG. 17D being a diagonal view of a portion of its case.
Figure 17B:
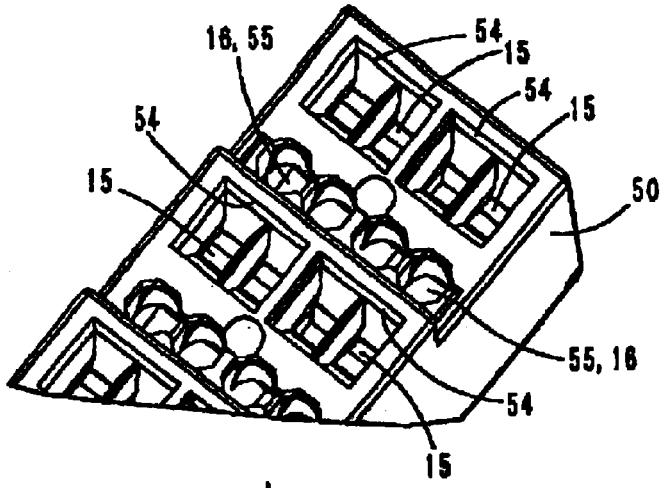
Figure 17C:
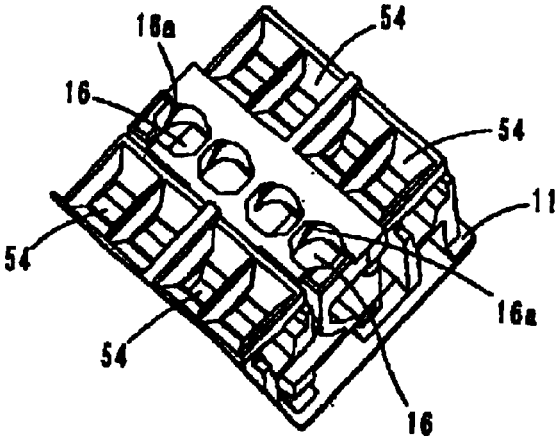
Figure 17D:
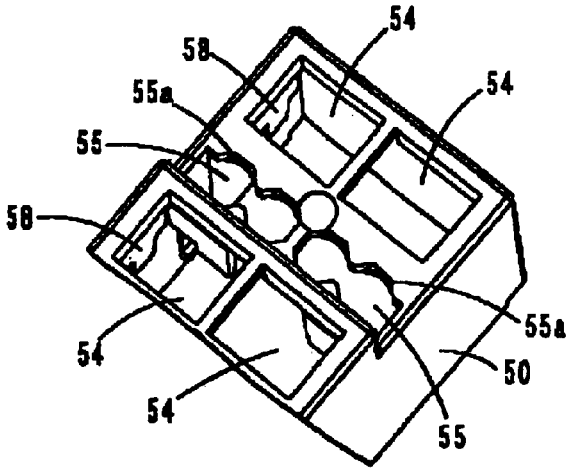
Figure 18A:
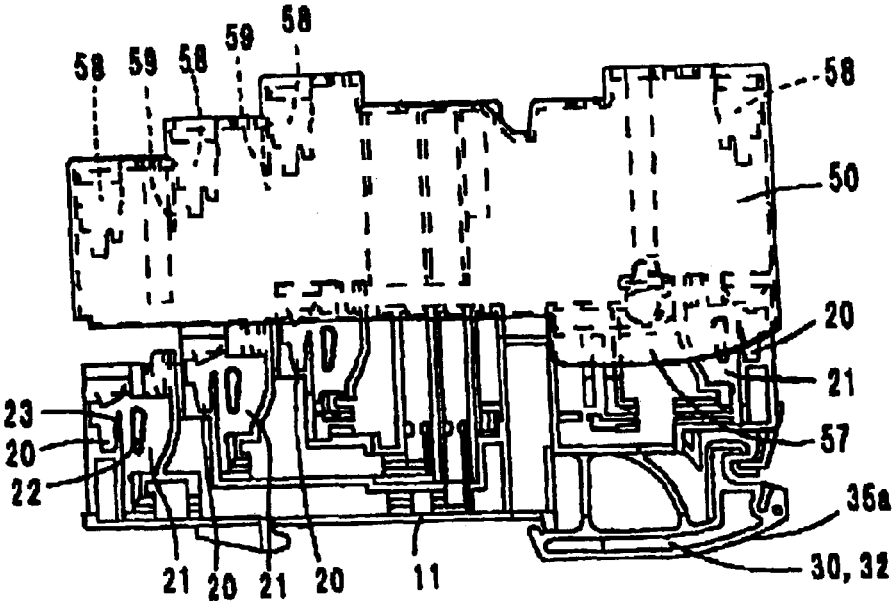
FIGS. 18A, 18B and 18C, together referred to as FIG. 18, show the connector of FIG. 16, FIG. 18A being its front view when its case is being engaged to its base, FIG. 18B being its front view after its case has been engaged to its base, and FIG. 18C being a sectional view taken along line 18C—18C of FIG. 18B.
Figure 18B:
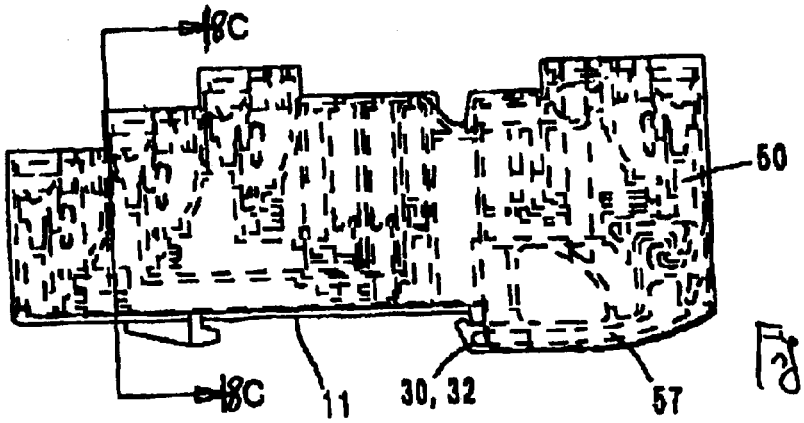
Figure 18C:
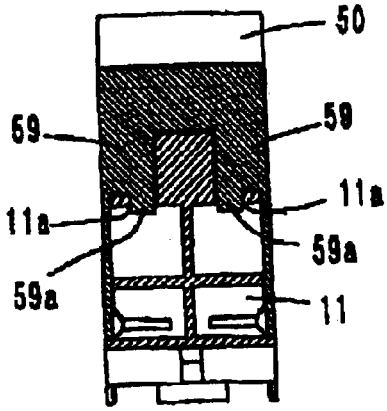

FIG. 13 relates to only one example of the lever 60 and is not intended to limit the scope of the invention. Many modifications and variations are possible within the scope of the invention. FIGS. 14A and 14B show a variation characterized as not having the attachment part 65 for a name plate. FIGS. 14C and 14D show another variation characterized as having no latches 68 protruding from the connecting arms 67. FIGS. 15A and 15B show still another variation characterized as having no connecting arms 67. As shown in FIGS. 15C and 15D, furthermore, the frame structure 66 need not be in the shape of a closed frame.

When the connector 10 is detachably mounted to a rail, the latch part 37 on the base 11 is engaged to one of the edge parts of the rail and the connector 10 as a whole is pressed against the rail. After the straight leg parts 33 and the arched leg part 34 are elastically deformed, they are returned to their original positions. As a result, the elongated downward protrusion 36 comes into contact with the other side edge of the rail and the protrusion 35*d* of the elastic hook 32 becomes engaged with the other side edge of the rail. The attachment to the rail is thus concluded.

When the rail, once attached, is removed from the connector 10, the tip of a tool such as a slotted screwdriver (not shown) is slid along the outwardly facing surface 31*c* from the opening 56 of the case 50 and positioned at the indentation 35*c* of the elastic hook 32 which is on the extension of the outwardly facing surface 31*c*, as explained above. The screwdriver is then operated so as to pull out the horizontal latch part 35 such that the straight and arched leg parts 33 and 34 are elastically deformed and the protrusion 35*d* becomes disengaged from the side edge of the rail and the connector 10 can be removed from the rail.

In summary, the connector 10 according to this invention can be set at any desired position on a rail by a single touch by a tool and can be removed equally easily. Since the elastic hook 32 is formed integrally with the base 11, the number of components to be assembled is small and the production process is not complicated.

Next, a method of connecting lead lines is explained with reference to FIG. 7 where the case 50 is not shown for the convenience of disclosure.

As the handling bar 80 is inserted into any of the handling bar holes 16 described above, it is guided along the guide surface 16*a* inside the hole 16 and positioned on a line tangent to the outer peripheral surface of the clamp spring 49. After the handling bar 80 is twisted to elastically deform the clamp spring 49, a lead line (not shown) is inserted into the connection hole 49*a* of the clamp spring 49 through the corresponding one of the lead line holes 15. As the handling bar 80 is thereafter pulled out of the handling bar hole 16, the clamp spring 49 is returned to the original position and the lead line is clamped between the clamp spring 40 and the corresponding one of the metal fittings (42 in FIG. 7). Similar operations are repeated such that even many lead lines can be easily connected.

For removing an inserted lead line, the handling bar 80 is inserted into the handling bar hole 16 along the guide surface 16*a* so as to compress and elastically deform the clamp spring 49 and to thereby release the clamping force on the lead line. The lead line is thereafter pulled out through the connection hole 49*a* of the clamp spring 49 and the handling bar 80 is thereafter pulled out.

FIGS. 16–19 relate to a second embodiment of this invention relating to a connector 10 for mounting a two-pole relay. According to this embodiment, as shown in FIG. 17, continuous guide surfaces 16*a* and 55*a* are formed in the handling bar holes 16 and 55 of its base 11 and case 50 for guiding the handling bar 80 to a desired position. Partition walls 16 with protrusions 59*a* are provided inside the case 50, as shown in FIG. 16 and engaging holes 11*a* are formed in the base 11 such that, as the protrusions 59*a* are inserted into the engaging holes 11*a*, the case 50 is prevented from warping outward and no gap is generated between the inner side surfaces of the case 50 and the outer side surfaces of the base 11. Thus, the structure is formed so as not to allow scraps of lead lines from falling off through such a gap. In other aspects, the structure is similar to the first embodiment and hence the description will be omitted.

Figure 19A:
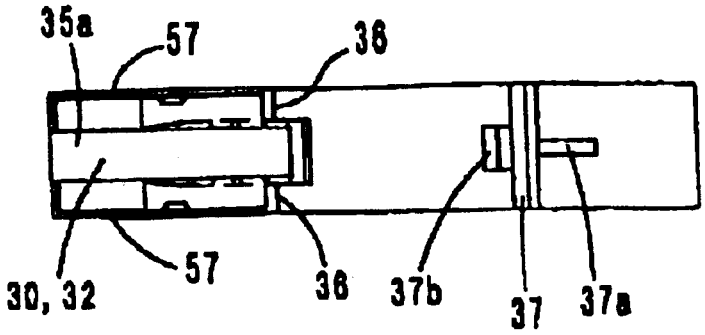
FIGS. 19A and 19B are respectively a bottom view and a diagonal view of the terminal shown in FIG. 16.
Figure 19B:
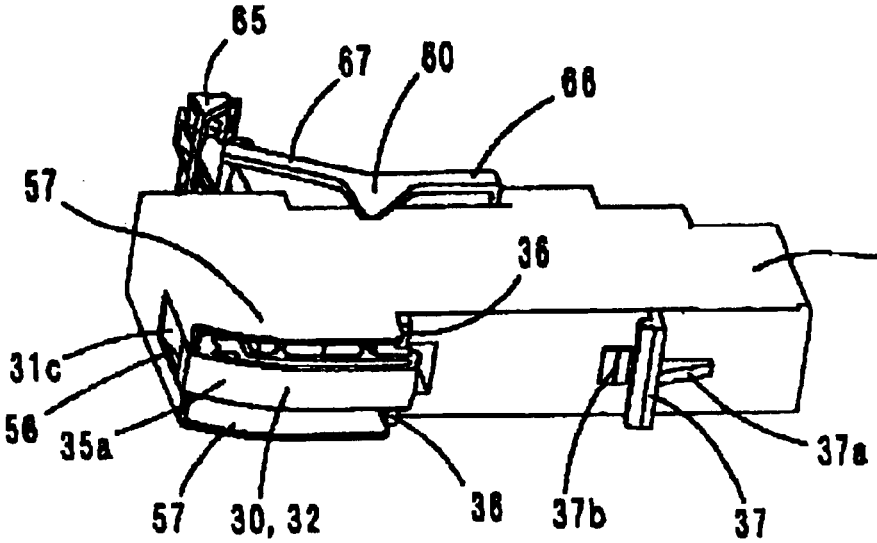
Figure 19C:
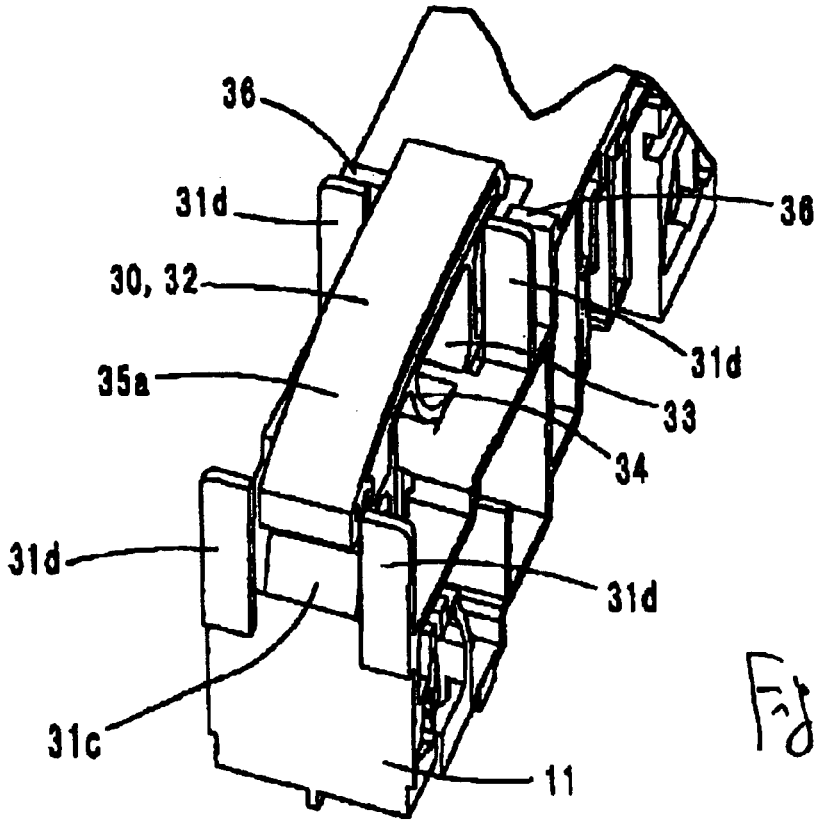
FIG. 19C is a diagonal view of a portion of another base.
Figure 20A:
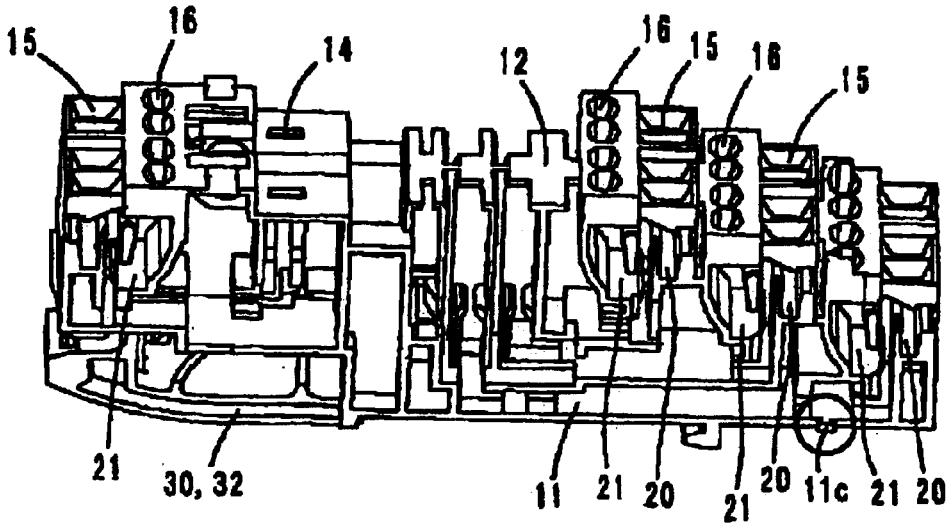
FIGS. 20A, 20B, 20C and 20D, together referred to as FIG. 20, show a connector according to a third embodiment of this invention, FIG. 20A being a diagonal view of its base, FIG. 20B being an enlarged view of a portion thereof, FIG. 20C being a diagonal view of its case, and FIG. 20D being an enlarged view of a portion thereof.
Figure 20B:
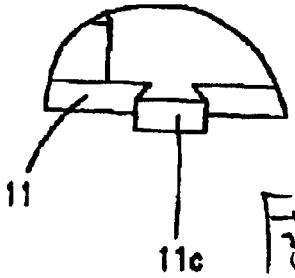
Figure 20D:
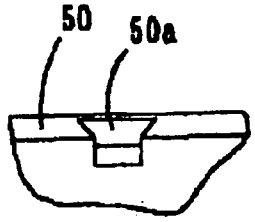
Figure 20C:
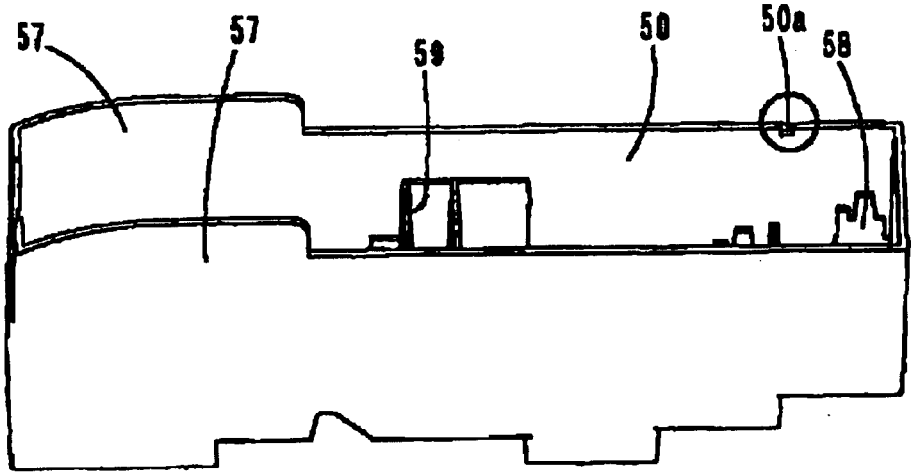
Figure 21B:
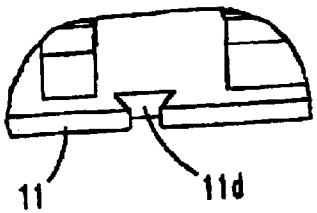
FIGS. 21A, 21B, 21C and 21D, together referred to as FIG. 21, show a connector according to a fourth embodiment of this invention, FIG. 21A being a diagonal view of its base, FIG. 21B being an enlarged view of a portion thereof, FIG. 21C being a diagonal view of its case, and FIG. 21D being an enlarged view of a portion thereof.
Figure 21D:
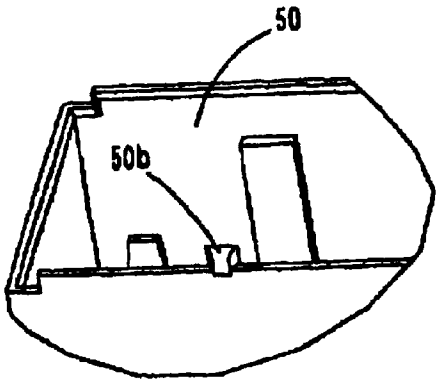
Figure 21A:
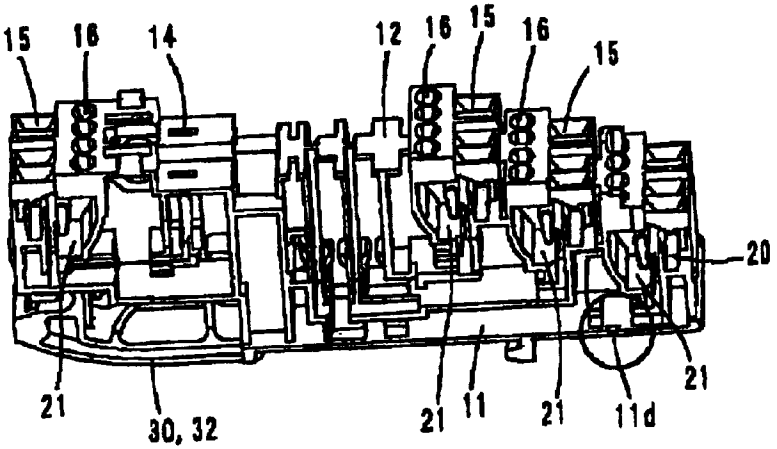
Figure 21C:
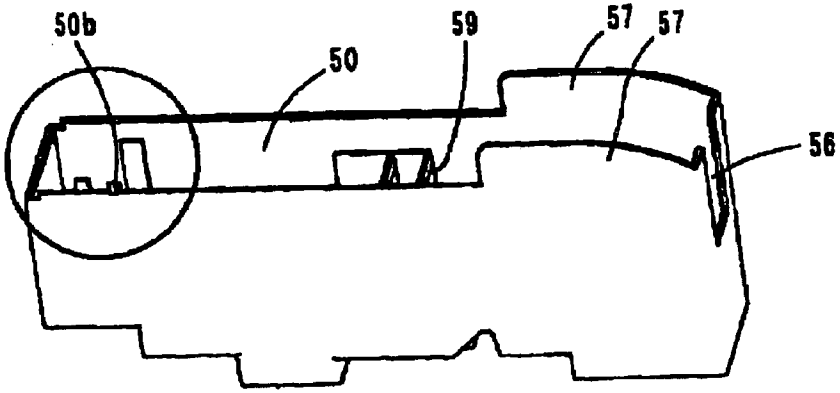

As a variation of the second embodiment, protruding support members 31*d* may be provided at the stepped part 31 of the base 11, as shown in FIG. 19C, for controlling the twisting deformation of the elastic hook 32. This variation is advantageous because the twisting kind of deformation of the elastic hook 32 can be more dependably controlled and the elastic hook 32 is less likely to be damaged.

FIG. 20 shows a third embodiment of the invention characterized as having a wedge-shaped protrusion 11*c* on the base 11 and an engaging indentation 50*a* at the open edge portion of the case 50. As the wedge-shaped protrusion 11*c* is engaged in this indentation 50*a*, the side wall of the case 50 can be prevented from warping outward.

FIG. 21 shows a fourth embodiment of the invention characterized as having a wedge-shaped cut 11*d* on the base 11 and an engaging protrusion 50*b* on the edge portion of the opening in the case 50. As the wedge-shaped cut 11*d* is engaged with the engaging protrusion 50*b* of the case 50, the side wall of the case 50 is likewise prevented from warping outward.

The aforementioned third and fourth embodiments of the invention are advantageous in that no gap is formed between the inner side surface of the case 50 and the outer side surface of the base 11 and hence no scrap of lead lines can fall out therethrough. This serves to prevent short circuits and to improve the insulating characteristics.

Figure 22A:
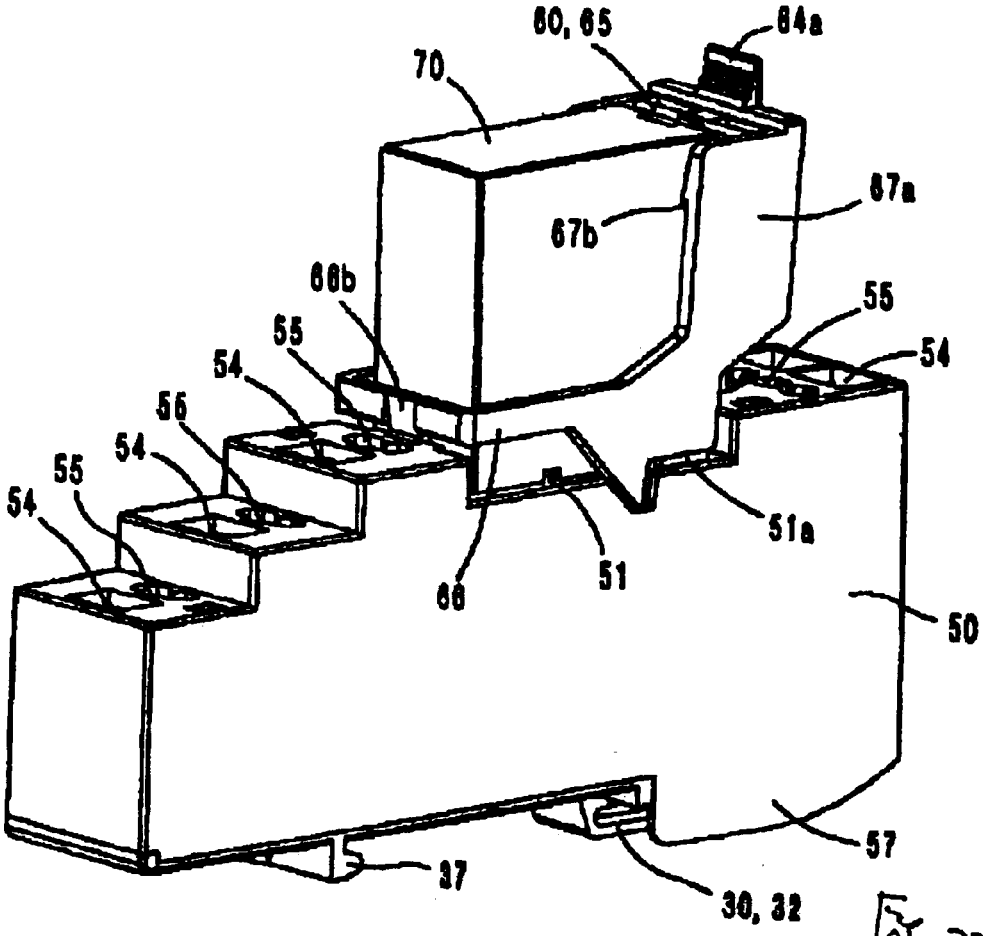
FIGS. 22A and 22B, together referred to as FIG. 22, show a connector according to a fifth embodiment of the invention, FIG. 22A being a diagonal view with a relay mounted thereto and FIG. 22B being an enlarged sectional view of a portion thereof.
Figure 22B:
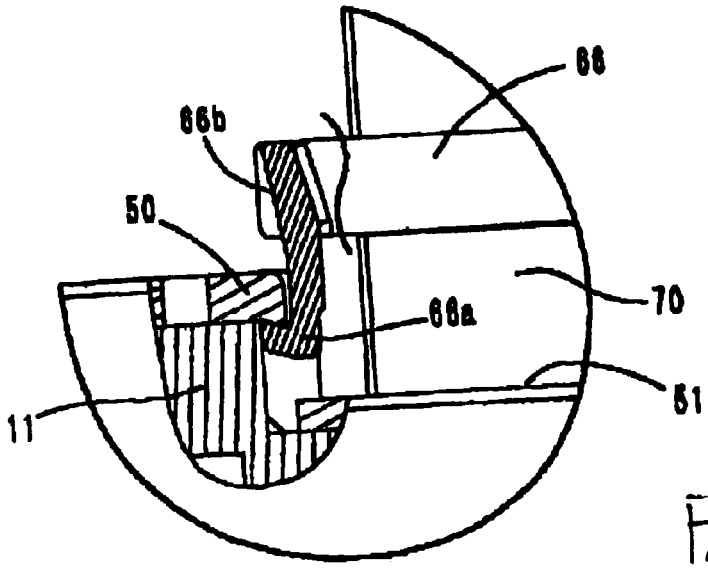
Figure 23B:
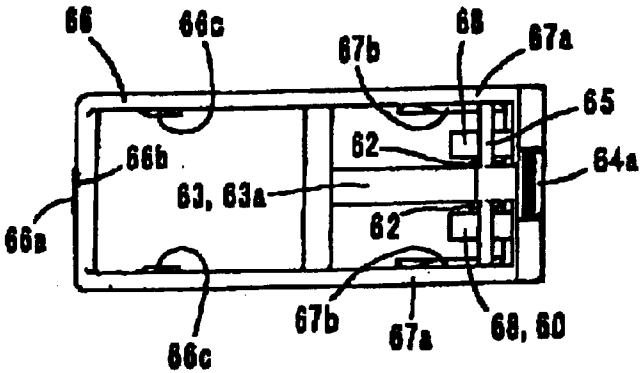
FIGS. 23A, 23B and 23C, together referred to as FIG. 23, show the lever shown in FIG. 22, FIG. 23A being its diagonal view, FIG. 23B being its plan view and FIG. 23C being its longitudinal sectional view.
Figure 23C:
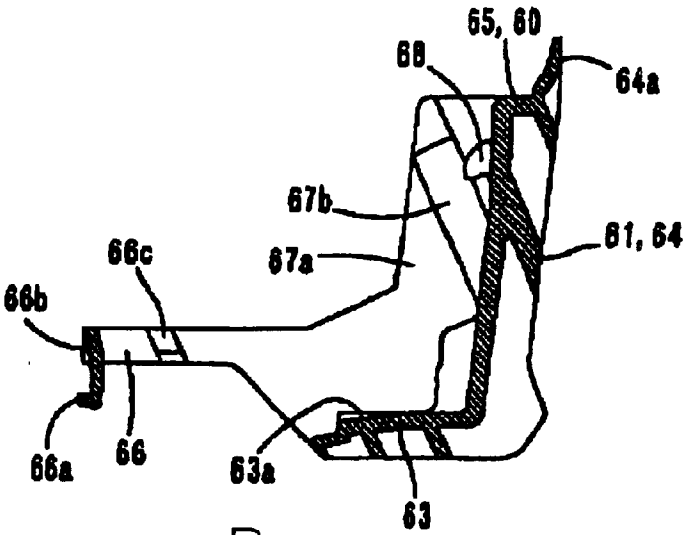
Figure 23A:
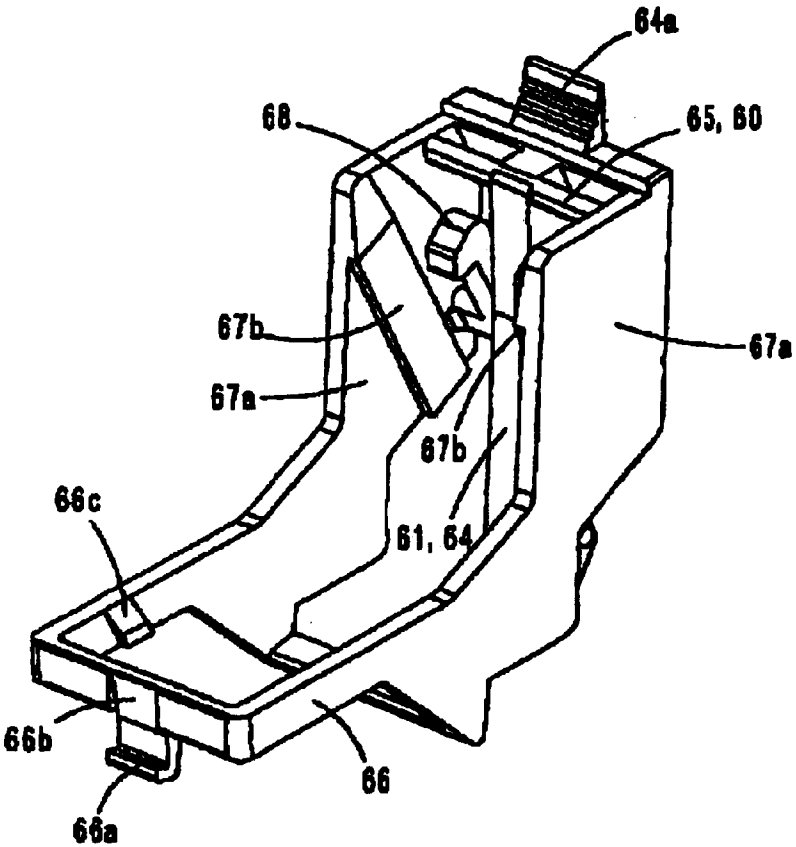
Figure 24A:
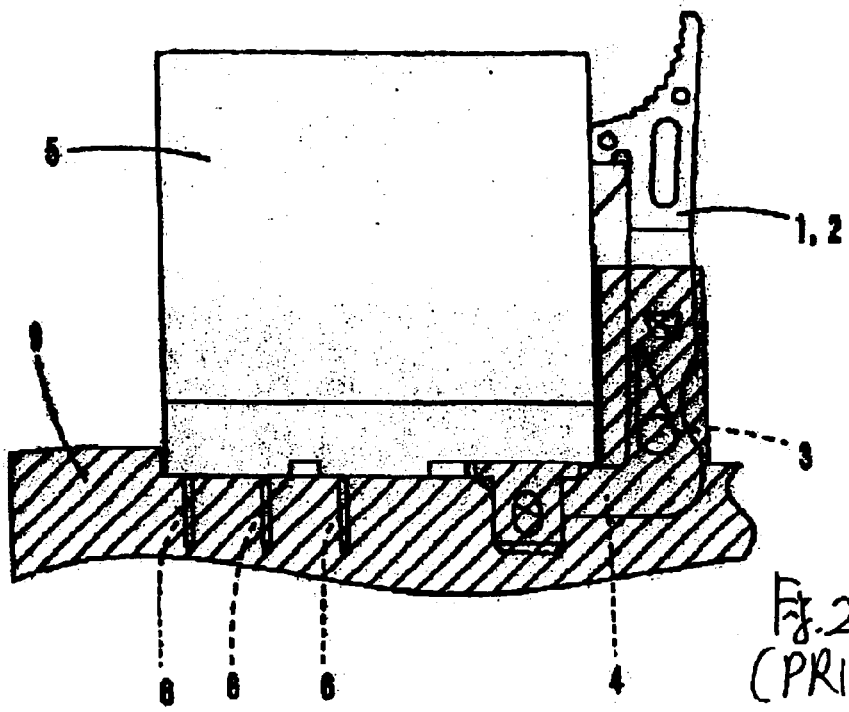
Fig. 24A (PRIOR ART)
FIGS. 24A and 24B, together referred to as FIG. 24, are side views of a prior art connector for an electric apparatus for explaining the method of using it.
Figure 24B:
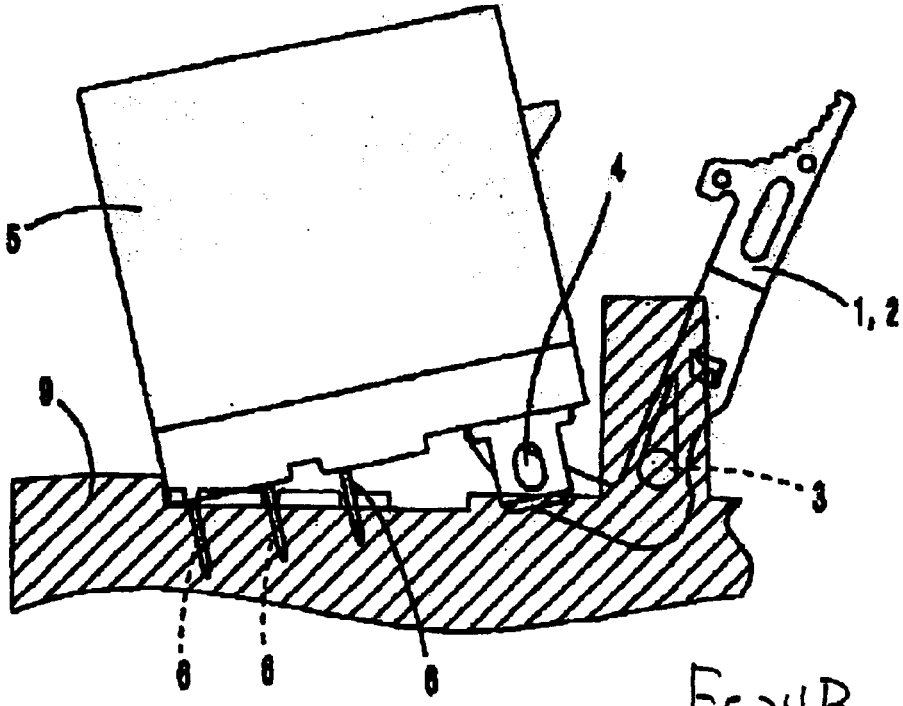
Fig. 24B (PRIOR ART)

FIGS. 22 and 23 show a fifth embodiment of the invention intended to improve resistance of the lever 60 against vibrations and impact forces so as to prevent the mounted relay 70 from rattling or falling off. For this purpose, the lever 60 according to this invention is provided with an engaging latch 66*a* at the tip of an elongated member 66 extending away from the rotary shaft 62 for limiting the rotary action. As the engaging latch 66*a* hooks onto the case 50, rotary motion of the lever 60 is inhibited and the relay 70 is prevented from falling off by vibrations. A guide area 66*b* is formed on the outwardly facing surface of the engaging latch 66*a* for guiding the handling bar (not shown) which is used for unlocking the latch 66*a*. Such an engaging latch may be provided elsewhere. For example, it may be provided on the horizontal arm 63 of the main body 61. It may be hooked to the base 11 of the housing.

This elongated member 66 is provided with reinforcing side walls 67*a* for improving the structural strength of the connection between the elongated member 66 and the name plate attachment part 65. Protruding lines 67*b* are provided on the inner surfaces of these reinforcing side walls 67*a* at positions corresponding to the center of gravity of the relay 70 which is to be mounted for preventing the mounted relay 70 from rattling by vibrations. Additional protrusions 66*c* for the same rattling-preventing purpose are formed on the inner surfaces of the elongated member 66.

The relay-mounting indentation 51 on the case 50 is provided with a protrusion 51*a* for contacting the bottom surface of the lever 60 and thereby preventing it from rattling. Such a protrusion may alternatively be provided to the base 11.

In summary, the connector 10 according to this embodiment locks the lever 60 onto the relay 70 by means of the engaging latch 66*a* to prevent the lever 60 from rotating and keeps the relay 70 at its position by means of the protruding lines 67*b* on the inner surfaces of the reinforcing side walls 67*a* as well as the protrusions 67*c* on the inner surfaces of the elongated member 66. Thus, the rattling of the relay 70 in the transverse direction can also be suppressed effectively. The lever 60 is further stabilized by means of the protrusion 51*a* contacting the bottom surface of the lever 60. Thus, this embodiment of the invention can provide a connector that is highly resistant against damage by impact forces and makes it difficult for the electric apparatus to fall off.

It goes without saying that this embodiment of the invention, too, can be applied to a situation wherein the base 11 and the case 50 are integrally formed into one housing structure.

Although the invention has been described above with reference to only a limited number of embodiments, these embodiments are not intended to limit the scope of the invention. Many modifications and variations are possible within the scope of the invention. All such modifications and variations that may be apparent to a person skilled in the art are intended to be within the scope of the invention.

What is claimed is:

1. A lever for removing an electric apparatus from a connector to which said electric apparatus is mounted, said lever comprising:

an L-shaped main body having a horizontal arm and a vertical arm joining at an angle-forming part, rotary shafts protruding coaxially from said angle-forming part and rotatably supported by said connector, said horizontal arm lifting said electric apparatus mounted to said connector as said main body is rotated around said rotary shafts; and a holding structure connected to and extending from an end of said horizontal arm away from said rotary shafts, said holding structure coming to contact a side surface of said electric apparatus facing away from said vertical arm when said main body is rotated by more than a specified angle.

2. The lever of claim 1 wherein said holding structure is a frame that surrounds said electric apparatus.

3. The lever of claim 1 further comprising connecting arms that connect and are formed integrally with said holding structure and said vertical arm.

4. The lever of claim 1 further comprising at least one latch beside said vertical arm for engaging with said electric apparatus.

5. The lever of claim 1 wherein said vertical arm includes an attachment part near its top end for attaching a name plate thereon.

* * * * *